US005484692A

United States Patent [19]

Mitsui et al.

[11] Patent Number: 5,484,692

[45] Date of Patent: Jan. 16, 1996

[54] SILVER HALIDE PHOTOGRAPHIC MATERIAL AND IMAGE FORMING METHOD USING THE SAME

[75] Inventors: Akio Mitsui; Hiroo Takizawa, both of Minami Ashigara, Japan

[73] Assignee: Fuji Photo Film Co., Ltd., Kanagawa, Japan

[21] Appl. No.: 295,107

[22] Filed: Aug. 24, 1994

[30] Foreign Application Priority Data

Sep. 8, 1993 [JP] Japan ..... 5-223156

[51] Int. Cl.[6] ..... G03C 1/46

[52] U.S. Cl. ..... 430/505; 430/543; 430/546; 430/535

[58] Field of Search ..... 430/546, 505, 430/555, 543

[56] References Cited

U.S. PATENT DOCUMENTS

| | | | |
|---|---|---|---|
| 2,322,027 | 6/1943 | Jelley et al. | 430/546 |
| 2,420,610 | 5/1947 | Mueller et al. | 430/529 |
| 4,326,022 | 4/1982 | Ito et al. | 430/546 |
| 4,639,413 | 1/1987 | Kawagishi et al. | 430/546 |
| 4,731,320 | 3/1988 | Sasaki et al. | 430/546 |
| 4,954,432 | 9/1990 | Nishijima et al. | 430/546 |
| 5,015,563 | 5/1991 | Ohya et al. | 430/546 |

FOREIGN PATENT DOCUMENTS

| | | |
|---|---|---|
| 0553964 | 8/1993 | European Pat. Off. . |
| 54-119922 | 9/1979 | Japan . |

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide photographic material comprising a support having provided thereon at least one layer, wherein said at least one layer contains at least one compound which is represented by the following formula (1) and is liquid at 25° C.:

(1)

wherein $R_1$ and $R_2$, which may be the same or different, each represents a hydrogen atom, an unsubstituted unsaturated straight-chain aliphatic group, or an unsubstituted branched alkyl group; provided that both $R_1$ and $R_2$ must not be hydrogen atoms and that the sum of the carbon atoms in $R_1$ and $R_2$ is 18 or more.

13 Claims, No Drawings

SILVER HALIDE PHOTOGRAPHIC MATERIAL AND IMAGE FORMING METHOD USING THE SAME

FIELD OF THE INVENTION

The present invention relates to a photographic material and, more precisely, to a photographic material having improved image quality and improved post-processing treatment suitability and also to an image-forming method using the material.

BACKGROUND OF THE INVENTION

Photographic materials that have been widely popularized in these days are such that silver halide emulsions were dispersed in a water-soluble colloid such as gelatin and the dispersions were coated on a support while they were crosslinked (hardened) with a crosslinking agent (hardening agent) so as not to dissolve out in processing solutions during development. In addition to these, various additives were added to photographic materials so as to ensure various photographic properties for them. Of these additives, hardly water-soluble photographically useful reagents (for example, oil-soluble couplers, antioxidants to be used for preventing fading, color-fogging and color-mixing (such as alkylhydroquinones, alkylphenols, chromans, coumarones, etc.), hardening agents, oil-soluble filter dyes, oil-soluble ultraviolet absorbents, oil-soluble brightening agents, DIR compounds (such as DIR hydroquinones, non-coloring DIR couplers, etc.), developing agents, color-developing agents, DDR redox compounds, DDR couplers) are first dissolved in a suitable oil-forming reagent or a high boiling point solvent, then the solutions are dispersed in a solution of a hydrophilic colloid, especially gelatin, in the presence of a surfactant, and the resulting dispersions are added to hydrophilic organic colloid layers (for example, light-sensitive emulsion layers, filter layers, backing layers, anti-halation layers, interlayers, protective layers). As high boiling point organic solvents, generally used are phthalate compounds and phosphate compounds.

Phthalate compounds and phosphate compounds which are high boiling point organic solvents have heretofore been much employed in this technical field, as being excellent in that they have high ability of dispersing couplers, high affinity for colloids such as gelatin, high ability of stabilizing color images formed and little influence on the hue of color images formed and that they are chemically stable in photographic materials and are available at low costs.

High boiling point organic solvents to be used in preparing recent photographic materials are needed to meet various requirements.

On the other hand, recently, there is a great need of having photographic prints seen immediately after photographing and a great need of minimizing the amounts of waste from photographic processing. In order to meet these needs, means for rapid photographic processing and means for LR (lowering replenishers) are being advanced greatly. However, such rapid photographic processing and LR involve various problems. For example, the processed photographic materials are much stained, the stability during development is impaired, the stability of images formed is impaired during storage, the graininess of processed photographic materials is decreased, the hue of color images formed is turbid, and the processed photographic materials are to be much stained after storage. It is an important theme to solve these problems in improving photographic materials these days.

In addition, photographic materials have become worked into various forms in these days, after being developed. For example, the surfaces of developed photographic materials are matted or textured by spraying or using surface-modifying rollers, or the developed photographic materials are laminated by sandwiching them with plastic films, are colored with special painting materials, or are decolored or bleached with various bleaching agents. It is understood that the aptitudes for such treatments greatly vary, depending on the planning of photographic materials. For example, some coloring materials were unfavorably discolored when sprayed with matting agents or when laminated, or were hardly bleached with bleaching agents, or were hardly painted with painting materials. Therefore, the post-processing treatment suitability of developed photographic materials was an extremely important matter for photographic materials.

SUMMARY OF THE INVENTION

As is obvious from the above-mentioned explanation, an object of the present invention is to provide a means for removing various troubles to be caused by rapid photographic processing and LR (lowered replenishers), especially preventing turbidity in the hue of color images formed and preventing increase in the stains of developed photographic materials with the lapse of time after development. It is also to provide a means for improving the post-processing treatment suitability of developed photographic materials, especially the bleachability thereof.

The object of the present invention can be attained by (1) a silver halide photographic material comprising a support having provided thereon at least one layer, wherein said at least one layer containing at least one compound, which is represented by the following formula (1) and is liquid at 25° C.:

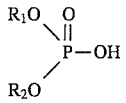

(1)

wherein $R_1$ and $R_2$, which may be the same or different, each represents a hydrogen atom, an unsubstituted unsaturated straight-chain aliphatic group, or an unsubstituted branched alkyl group; provided that both $R_1$ and $R_2$ must not be hydrogen atoms and that the sum of the carbon atoms in $R_1$ and $R_2$ is 18 or more.

(2) It can also be attained by a silver halide photographic material of (1), which is a color photographic material comprising a support having provided thereon at least one yellow dye-forming coupler-containing silver halide emulsion layer, at least one magenta dye-forming coupler-containing silver halide emulsion layer and at least one cyan dye-forming coupler-containing silver halide emulsion layer, said yellow dye-forming coupler-containing silver halide emulsion layer, said magenta dye-forming coupler-containing silver halide emulsion layer and said cyan dye-forming coupler-containing silver halide emulsion layer have a different color sensitivity from one another, wherein at least one of said coupler-containing silver halide emulsion layers contains at least one of the compounds represented by the formula (1) as a coupler-dispersing medium.

(3) It can also be attained by a silver halide photographic material of (2), wherein the coupler to be dispersed in said compound has an oil PKa' of from 7.0 to 13.0.

(4) It can also be attained by a silver halide photographic material of (2) or (3), which is developed by a process where at least one processing bath contains a processing solution having a pH of from 10.8 to 12.5 and having a bromide content of from 0.005 mol/liter to 0.1 mol/liter.

(5) It can also be attained by a silver halide photographic material of (1), wherein said at least one layer contains at least one magenta dye-forming coupler.

(6) It can also be attained by a silver halide photographic material of (5), wherein the magenta dye-forming coupler is represented by the following formula (m):

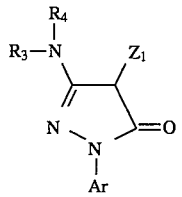

(m)

wherein $R_3$ and $R_4$ each represents an aliphatic group, an aryl group, an acyl group, or a carbamoyl group, $R_3$ and $R_4$ may be bonded to each other to form a ring; Ar represents a phenyl group, or a phenyl group substituted by one or more substituents selected from among a halogen atom, an alkyl group, a cyano group, an alkoxy group, an alkoxycarbonyl group and an acylamino group; and $Z_1$ represents a hydrogen atom, or a group capable of splitting off from the compound by the reaction with an oxidation product of an aromatic primary amine developing agent.

(7) It can also be attained by a method for forming a photographic image comprising subjecting a color silver halide photographic material of (2) or (3) to color reversal processing using a first developer (black-and-white developer) having a bromide content of from 0.02 mol/liter to 0.1 mol/liter.

DETAILED DESCRIPTION OF THE INVENTION

The compounds represented by the formula (1) to be used in the present invention will be explained in detail hereunder.

The compounds represented by the formula (1) is an oily matter.

In the formula (1), the branched alkyl group may be composed of either a single component or a mixture of some isomers (hereinafter referred to as a branched mixture). Especially preferably, it is a branched mixture, as the compound has a low melting point.

The unsaturated straight-chain aliphatic group in the formula (1) may be either a mixture of cis/trans isomers (hereinafter referred to as an isomer mixture) or a single cis- or trans-compound. Especially preferably, it is an isomer mixture, as the compound has a low melting point.

More precisely, in the formula (1), $R_1$ and $R_2$ each represents a hydrogen atom, an unsubstituted unsaturated straight-chain aliphatic group (e.g., allyl, oleyl, 10-undecen-1-yl, 2-decen-1-yl), or an unsubstituted branched alkyl group (e.g., i-propyl, t-butyl, 2-ethylhexyl, 3,5,5-trimethylhexyl, i-decyl (branched mixture), i-dodecyl (branched mixture), 2-hexyldecyl). $R_1$ and $R_2$ may be the same or different, but both of them must not be hydrogen atoms.

The sum of the carbon atoms in $R_1$ and $R_2$ is 18 or more, preferably 20 or more, more preferably 24 or more.

$R_1$ or $R_2$ may be an unsaturated and branched aliphatic group.

Specific examples of $R_1$ and $R_2$ are mentioned below, which, however, are not limitative.

$-C_3H_7-i$, $-C_4H_9-t$, $-C_5H_{11}-i$,

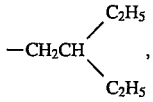

$-C_7H_{11}$ (branched mixture),

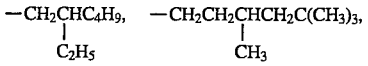

$-C_8H_{17}-t$, $-C_9H_{19}$ (branched mixture), $-C_{10}H_{21}$ (branched mixture), $-C_{13}H_{27}$ (branched mixture),

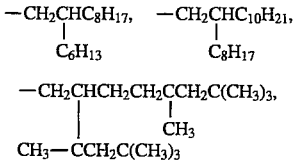

$-CH_2CH=CH_2$, $-(CH_2)_8CH=CH-C_8H_{17}$, $-(CH_2)_8CH=CH_2$, $-C(CH_2)_9CH=CH_2$ $-CH_2CH=CH-C_7H_{15}$, $-CH_2CH=CHC_9H_{17}$

Specific examples of compounds of the formula (1) for use in the present invention are mentioned below, which, however, are not limitative.

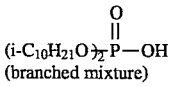

(branched mixture) S-1

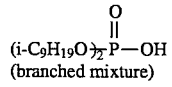

(branched mixture) S-2

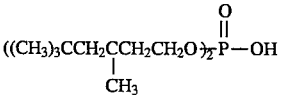

S-3

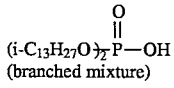

(branched mixture) S-4

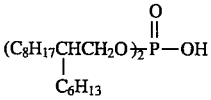

S-5

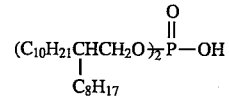

S-6

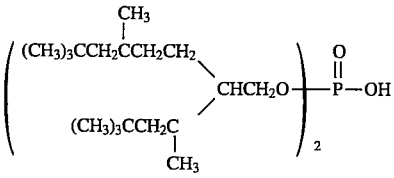

S-7

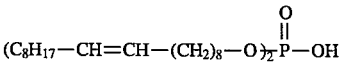

S-8

-continued

S-9

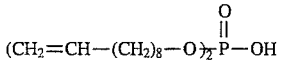

S-10

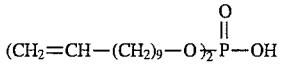

S-11

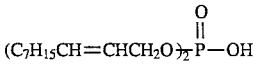

S-12

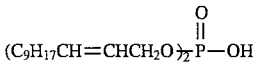

S-13

(branched mixture)

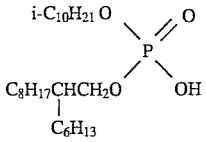

S-14

(branched mixture)

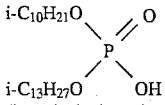

(branched mixture)

S-15

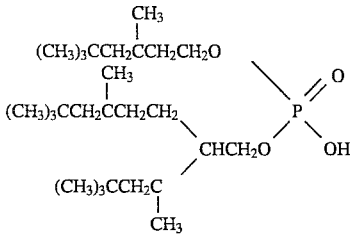

S-16

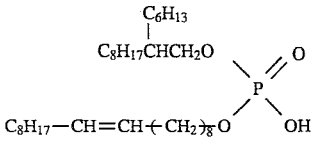

S-17

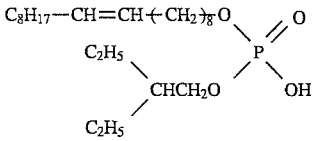

S-18

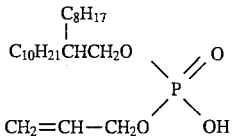

S-19

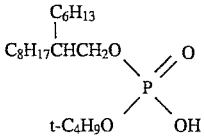

S-20

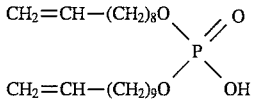

S-21

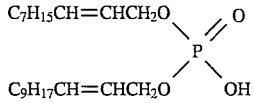

-continued

S-22

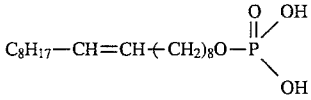

S-23

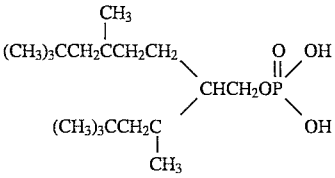

S-24

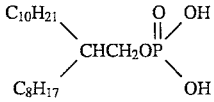

S-25

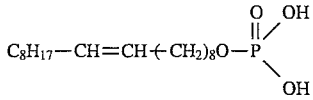

Compounds represented by the formula (1) for use in the present invention are easily produced by known reaction of phosphorus oxychloride and an alcohol.

The reason why these compounds liquid at 25° C. are especially effective in the present invention could not be said to be sufficiently clarified but may be considered because of the following three points:

When development is effected more rapidly, the time for washing with water or rinsing in the final step will be shortened more so that the unnecessary components will be insufficiently removed from the processed photographic material. In addition, due to lowering of the amounts of replenishers to be added, the contents of the unnecessary components will increase in the developer being used.

(1) When these compounds liquid at 25° C. are used, the viscosity of oil drops of coupler dispersions is lowered so that the developing agent used may easily penetrate into the photographic material being processed to accelerate the development of the photographic material.

(2) Since the viscosity of such oil drops is low, the efficiency for removing the unnecessary components in the washing step is elevated. Accordingly, the insoluble components hardly remain in the oil drops. In addition, due to the specific effect of the oil, the influences (for example, increasing stains of processed photographic materials with the lapse of time during storage) of the remained unnecessary components (especially, developing agent) may be eliminated.

(3) To bleach dyes in developed photographic materials, the bleaching agent may be rapidly penetrated into the photographic materials since the viscosity of the oil drops is low, so that the bleaching time may be shortened.

In order that the compounds represented by the formula (1) for use in the present invention are liquid at 25° C., it is indispensable that $R_1$ and/or $R_2$ in the formula (1) are/is a branched alkyl group or an alkyl group having unsaturated bond(s).

Phosphates similar to the compounds represented by the formula (1) for use in the present invention are already known. For example, trialkyl phosphates are described in JP-A-54-119235, JP-A-54-119921 and JP-A-54 -119922 (the term "JP-A" as used herein means an "unexamined published Japanese patent application"); and dialkyl phosphates which are solid at room temperature are described in EP-A-553964. However, trialkyl phosphates are greatly different from dialkyl phosphates with respect to their physical properties and therefore do not have the effect of the present invention. In addition, solid dialkyl phosphates were found ineffective because of the above-mentioned reasons.

The compound represented by the formula (1) is present in at least one layer on the support, and the layer may be any hydrophilic colloid layer. Preferably, the compound is added to a silver halide emulsion layer containing at least one dye-forming non-diffusive coupler.

Compounds represented by the formula (1) for use in the present invention function essentially as high boiling point organic solvents. "High boiling point" as referred to herein means a boiling point of 175° C. or higher at normal pressure. The amount of the compound represented by the formula (1) to be used in the present invention may be varied, according to the object of the invention, and is therefore not specifically defined. Preferably, the amount may be from 0.0002 g to 10 g, more preferably from 0.001 g to 2 g, per $m^2$ of the photographic material. In general, the ratio of the amount of the compound represented by the formula (1) is within the range of from 0.1 to 4 by weight, preferably from 0.1 to 1 by weight, to the amount of the photographically useful reagent, such as couplers, used along with it.

The ratio of the amount of the dispersion comprising the compound represented by the formula (1) and a photographically useful reagent, such as couplers, to the amount of the dispersing medium used for dispersing them is within the range of from 0.1 to 2, preferably from 0.2 to 1.0, to 1 of the dispersing medium. The dispersing medium is typically gelatin, including hydrophilic polymers such as polyvinyl alcohol. The dispersion may contain other various compounds according to the object of the invention, in addition to the compound represented by the formula (1) and a photographically useful reagent.

Compounds represented by the formula (1) are employed in the present invention preferably along with conventional high boiling point organic solvents. Where conventional high boiling point organic solvents are combined with compounds represented by the formula (1) in the present invention, the amount of the latter is preferably from 1 to 90% by weight, more preferably from 3 to 50% by weight, of the total amount of the combined high boiling point organic solvents.

Examples of high boiling point solvents employable along with compounds represented by the formula (1) in the present invention are described in U.S. Pat. No. 2,322,027. Examples of high boiling point organic solvents having a boiling point of 175° C. or higher at normal pressure, which are usable in the present invention, include phthalates (e.g., dibutyl phthalate, dicyclohexyl phthalate, di-2 -ethylhexyl phthalate, decyl phthalate, bis(2,4-di-tert-amylphenyl) phthalate, bis(2,4-di-tert-amylphenyl) isophthalate, bis(1,1-diethylpropyl) phthalate), phosphates and phosphonates (e.g., triphenyl phosphate, tricresyl phosphate, 2-ethylhexyldiphenyl phosphate, tricyclohexyl phosphate, tri-2-ethylhexyl phosphate, tridodecyl phosphate, tributoxyethyl phosphate, trichloropropyl phosphate, di-2-ethylhexylphenyl phosphonate), benzoates (e.g., 2-ethylhexyl benzoate, dodecyl benzoate, 2-ethylhexyl p-hydroxybenzoate), amides (e.g., N,N-diethyldodecanamide, N,N-dilaurylamide, N-tetradecylpyrrolidone), sulfonamides (e.g., N-butylbenzenesulfonamide), alcohols and phenols (e.g., isostearyl alcohol, 2,4-di-tert-amylphenol), aliphatic carboxylates (e.g., bis(2-ethylhexyl) sebacate, dioctyl azelate, glycerol tributyrate, isostearyl lactate, trioctyl citrate), aniline derivatives (e.g., N,N-dibutyl- 2-butoxy-5-tert-octylaniline), hydrocarbons (e.g., paraffin, dodecylbenzene, diisopropylnaphthalene), chloroparaffins, etc. Especially preferred are phosphates and phthalates. As auxiliary solvents, usable are organic solvents having a boiling point of 30° C. or higher, preferably from 50° C. to about 160° C. As specific examples of such solvents, mentioned are ethyl acetate, butyl acetate, ethyl propionate, methyl ethyl ketone, cyclohexanone, 2-ethoxyethyl acetate, dimethylformamide, etc.

Various techniques and inorganic and organic materials which are employable in preparing the silver halide photographic emulsions of the present invention and the silver halide photographic materials of the present invention containing them are described in *Research Disclosure* No. 308119 (December 1989).

In addition to these, more concrete examples of other various techniques and inorganic and organic materials employable in preparing color photographic materials of the present invention may be applied are described in EP-A-436938 and other patents mentioned below.

| | |
|---|---|
| 1. Layer Structures | EP-A-436938, from page 146, line 34 to page 147, line 25 |
| 2. Silver Halide Emulsions | EP-A-436938, from page 147, line 26 to page 148, line 12 |
| 3. Yellow Couplers | EP-A-436938, from page 137, line 35 to page 146, line 33, and page 149, lines 21 to 23 |
| 4. Magenta Couplers | EP-A-436938, page 149, lines 24 to 28; EP-A-421453, from page 3, line 5 to page 25, line 55 |
| 5. Cyan Couplers | EP-A-436938, page 149, lines 29 to 33; EP-A-432804, from page 3, line 28 to page 40, line 2 |
| 6. Polymer Couplers | EP-A-436938, page 149, lines 34 to 38; EP-A-435334, from page 113, line 39 to page 123, line 37 |
| 7. Colored Couplers | EP-A-436938, from page 53, line 42 to page 137, line 34, and page 149, lines 39 to 45 |
| 8. Other Functional Couplers | EP-A-436938, from page 7, line 1 to page 53, line 41, and from page 149, line 46 to page 150, line 3; EP-A-435334, from page 3, line 1 to page 29, line 50 |
| 9. Antiseptics, Antifungals | EP-A-436938, page 150, lines 25 to 28 |
| 10. Formalin Scavengers | EP-A-436938, page 149, lines 15 to 17 |
| 11. Other Additives | EP-A-436938, page 153, lines 38 to 47; EP-A-421453, from page 75, line 21 to page 84, line 56, and from page 27, line 40 to page 37, line 40 |
| 12. Dispersing Methods | EP-A-436938, page 150, lines 4 to 24 |
| 13. Supports | EP-A-436938, page 150, lines 32 to 34 |
| 14. Thickness of Films, Properties of Films | EP-A-436938, page 150, lines 35 to 49 |
| 15. Color Development Steps | EP-A-436938, from page 150, line 50 to page 151, line 47 |
| 16. Desilvering Steps | EP-A-436938, from page 151, line 48 to page 152, line 53 |
| 17. Automatic Developing Machines | EP-A-436938, from page 152, line 54 to page 153, line 2 |
| 18. Washing and Stabilizing Steps | EP-A-436938, page 153, lines 3 to 37 |

Color couplers to be in the photographic materials of the present invention are preferably those having an oil PKa' of 7.0 or more, especially preferably 8.0 or more.

"Oil PKa'" as referred to herein is a value to be obtained by the following measuring method: 0.15 mmols of a coupler to be measured (for polymer couplers, one containing 0.15 mmols of the monomer coupler constituting it) are dissolved in 2.4 ml of tri-n-butyl phosphate, 9 ml of an aqueous solution of 0.5 g/liter of potassium chloride are added thereto, and this is titered with an aqueous solution of 0.5N potassium hydroxide while stirring in a nitrogen stream, whereupon the pH value at the middle point between the turning points in the titration curve is referred to as an oil PKa' of the coupler. As the titration device, used is HTM-104 Model made by Toa Dempa Co.

As the magenta couplers to be used in the present invention, preferred are 5-pyrazolone compounds and pyrazoloazole compounds. Above all, especially preferred are 5-pyrazolone magenta couplers represented by the above-mentioned formula (m).

In the formula (m), $R_3$ and $R_4$ each represents an aliphatic group, an aryl group, an acyl group, or a carbamoyl group. Precisely, the aliphatic group is a linear or branched alkyl, aralkyl, alkenyl or alkynyl group having from 1 to 42 carbon atoms, or a cycloalkyl or cycloalkenyl group having from 3 to 42 carbon atoms; the aryl group is an aryl group having from 6 to 46 carbon atoms; the acyl group is an aliphatic acyl group having from 2 to 32 carbon atoms, or an aromatic acyl group having from 7 to 46 carbon atoms; and the carbamoyl group is an aliphatic carbamoyl group having from 2 to 32 carbon atoms, or an aromatic carbamoyl group having from 7 to 46 carbon atoms. These groups may optionally have one or more substituents, which are organic substituents bonding to the group via a carbon, oxygen, nitrogen or sulfur atom, or halogen atoms.

More precisely, $R_3$ and $R_4$ each represents an alkyl group (e.g., methyl, ethyl, propyl, butyl, octadecyl, isopropyl, t-butyl, cyclopentyl, cyclohexyl, methoxyethyl, ethoxyethyl, t-butoxyethyl, phenoxyethyl, methanesulfonylethyl, 2-(2,4-di-tert-amylphenoxy)ethyl), an aryl group (e.g., phenyl, 2-chlorophenyl, 2 -methoxyphenyl, 2-chloro-5-tetradecanamidophenyl, 2-chloro- 5-(3-octadecenyl-1-succinimido)phenyl, 2-chloro-5 -octadecylsulfonamidophenyl, 5-hexadecanamidophenyl, 2 -chloro-5-[2-(4-hydroxy-3-tert-butylphenoxy)tetradecanamideophenyl]), an acyl group (e.g., acetyl, pivaloyl, tetradecanoyl, 2-(2,4-di-tert-pentylphenoxy)-acetyl, 2-(2,4-di-tert-pentylphenoxy)butanoyl, benzoyl, 3-(2,4 -di-tert-amylphenoxyacetamido)benzoyl), or a carbamoyl group (e.g., N-methylcarbamoyl, N,N-dimethylcarbamoyl, N-hexadecylcarbamoyl, N-methyl-N-phenylcarbamoyl, N-[3-{1 -(2,4-di-tert-pentylphenoxy)butylamido}]phenylcarbamoyl). These groups may optionally be substituted by one or more substituents. Precisely, such substituents include, for example, an alkyl group, an aryl group, a heterocyclic group, a cyano group, a hydroxy group, a nitro group, a carboxyl group, an amino group, an acyl group, an aryloxycarbonyl group, an alkoxycarbonyl group, a carbamoyl group, an alkoxy group, an aryloxy group, a heterocyclic-oxy group, an acyloxy group, a carbamoyloxy group, a silyloxy group, an aryloxycarbonylamino group, an acylamino group, an alkylamino group, an anilino group, an ureido group, a sulfamoylamino group, an alkoxycarbonylamino group, a sulfonamido group, an aryloxycarbonylamino group, an imido group, an alkylthio group, an arylthio group, a heterocyclic-thio group, a sulfamoyl group, a sulfonyl group, a sulfinyl group, an azo group, a phosphonyl group, an azolyl group, a fluorine atom, a chlorine atom and a bromine atom. $R_3$ is preferably an aryl group or an acyl group. Ar represents a phenyl group, or a phenyl group substituted by one or more substituents chosen from among a halogen atom, an alkyl group, a cyano group, an alkoxy group, an alkoxycarbonyl group and an acylamino group. Precisely, Ar represents, for example, a phenyl group, a 2,4,6 -trichlorophenyl group, a 2,5-dichlorophenyl group, a 2,4 -dimethyl-6-methoxyphenyl group, a 2,6-dichloro-4-methoxyphenyl group, a 2,6-dichloro-4-ethoxycarbonylphenyl group, a 2,6-dichloro-4-cyanophenyl group, a 2,3,4,5-tetrachlorophenyl group, a pentachlorophenyl group, a 4-cyano- 2,3,5,6-tetrachlorophenyl group, a 4-ethoxycarbonyl- 2,3,5,6-tetrachlorophenyl group, or a 4-[2-(2,4-di-tert-amylphenoxy)butylamido] phenyl group. Preferably, Ar represents a 2,4,6-trichlorophenyl group, a pentachlorophenyl group, a 4-cyano-2,3,5,6-tetrachlorophenyl group, a 4-methoxycarbonyl-2,3,5,6-tetrachlorophenyl group, or a 2,5-dichlorophenyl group.

$Z_1$ represents a hydrogen atom or a coupling split-off group. Precisely, the coupling split-off group includes, for example, a halogen atom, an alkoxy group, an aryloxy group, an acyloxy group, a sulfonyloxy group, an amido group, an alkoxycarbonyloxy group, an aryloxycarbonyloxy group, an alkyl-, aryl- or heterocyclic-thio group, an imido group, a 5-membered or 6-membered nitrogen-containing heterocyclic group, and an arylazo group. These groups may optionally be substituted by one or more substituents such as those mentioned hereinabove as substituents for $R_3$. More precisely, the coupling split-off group of $Z_1$ includes, for example, a halogen atom (e.g., fluorine, chlorine, bromine), an alkoxy group (e.g., dodecyloxy, dodecyloxycarbonylmethoxy, methoxycarbamoylmethoxy, carboxypropyloxy, methanesulfonyloxy), an aryloxy group (e.g., 4-methylphenoxy, 4 -tert-butylphenoxy, 4-methoxyphenoxy, 4-methanesulfonylphenoxy, 4-(4-benzyloxyphenylsulfonyl)phenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, methanesulfonylamino, triphenylphosphonamido), an alkoxycarbonyloxy group (e.g., ethoxycarbonyloxy, benzyloxycarbonyloxy), an aryloxycarbonyloxy group (e.g., phenoxycarbonyloxy, 2,4,6 -trimethylphenoxycarbonyl), an alkyl-, aryl- or heterocyclic-thio group (e.g., dodecylthio, benzylthio, 1 -carboxydodecylthio, phenylthio, 2-butoxy-5-tert-octylphenylthio, 2,5-dioctyloxyphenylthio, 2-(2-ethoxyethoxy)- 5-tert-octylphenylthio, 2-pivaloylaminophenylthio, tetrazolylthio), an imido group (e.g., succinimido, hydantoinyl, 2,4-dioxoxazolidin-3-yl, 3-benzyl-4 -ethoxyhydantoin-1-yl), a 5-membered or 6-membered nitrogen-containing heterocyclic group (e.g., 1-pyrazolyl, 1-benzotriazolyl, 5-chloro-1,2,4-triazol-1-yl, 1,2 -dihydro-2-oxo-1-pyridyl), an arylazo group (e.g., phenylazo, 4-methoxyphenylazo), etc. In addition to these, $Z_1$ may be in the form of a bis-type coupler to be obtained by condensation of a 4-equivalent coupler and an aldehyde or a ketone. $Z_1$ may contain a photographically-useful group, which, for example, releases a development inhibitor or a development accelerator. Preferably, $Z_1$ is a hydrogen atom, or an alkyl-, aryl- or heterocyclic-thio group, or a 5-membered or 6-membered nitrogen-containing heterocyclic group which bonds to the coupling-active position of the formula via its nitrogen atom.

$R_3$ and $R_4$ may be bonded to each other to form a ring, preferably a 5-membered or 6-membered ring.

Specific examples of the magenta couplers represented by the formula (m) will be mentioned below, which, however, are not limitative.

Examples of Magenta Couplers represented by the Formula (m):

(m-1)
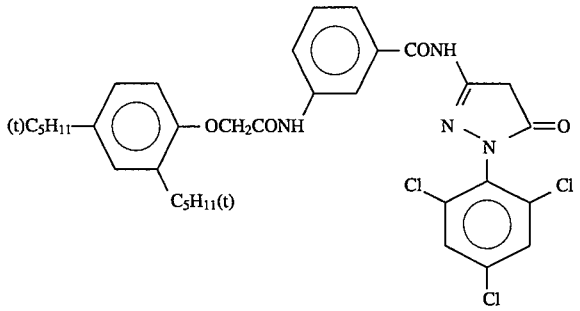
(m-2)
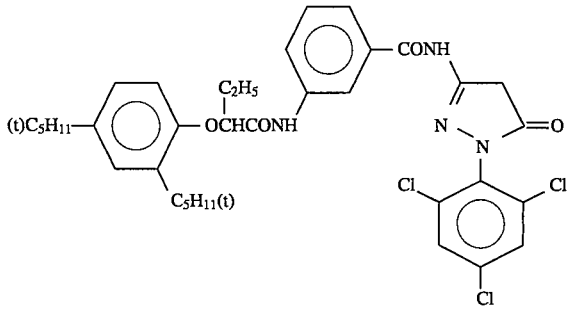
(m-3)
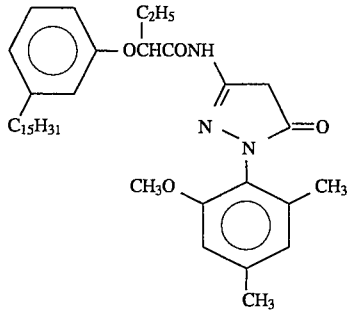
(m-4)
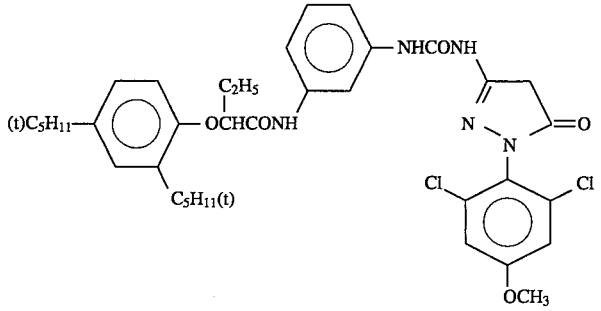
(m-5)
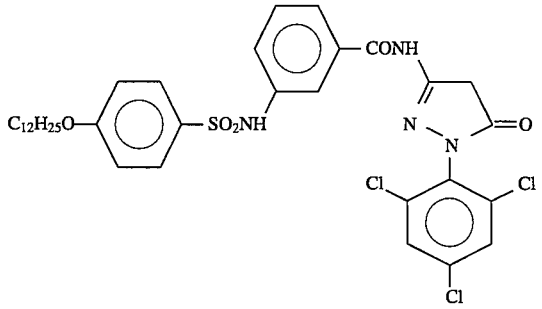

-continued
(m-6)
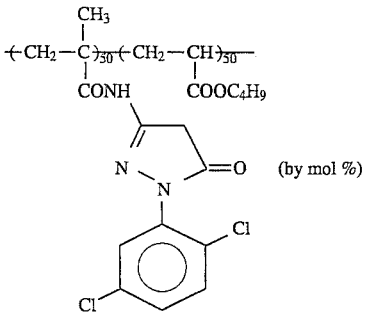
(by mol %)
(m-7)
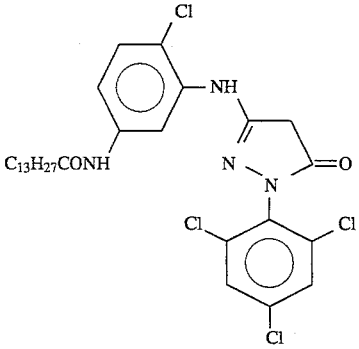
(m-8)
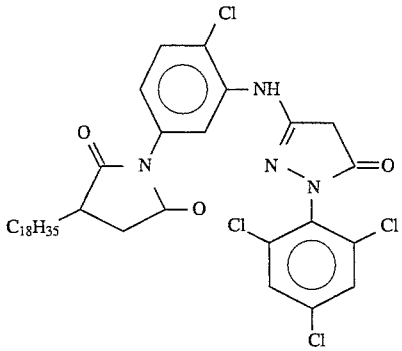
(m-9)
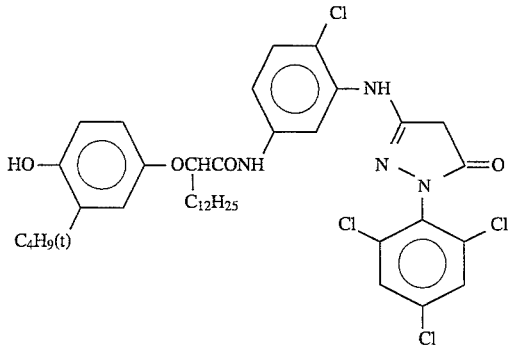

-continued
(m-10)
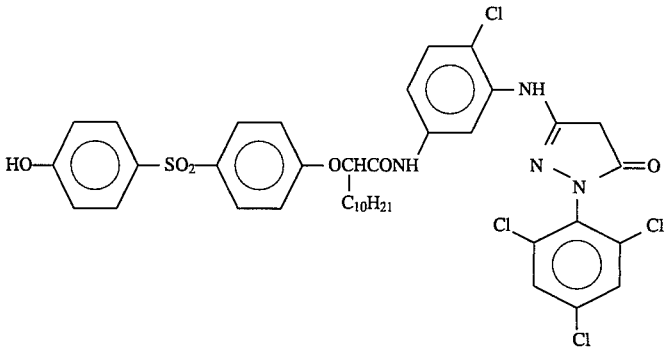
(m-11)
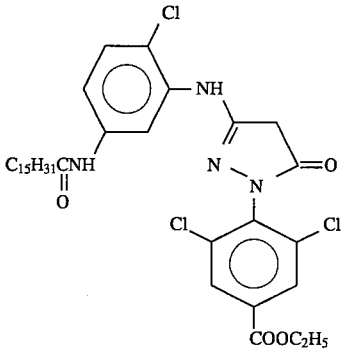
(m-12)
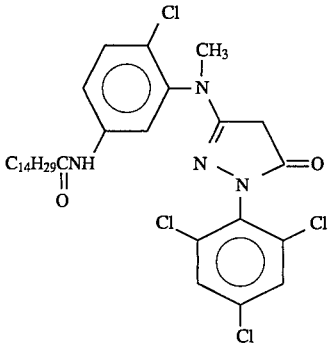
(m-13)
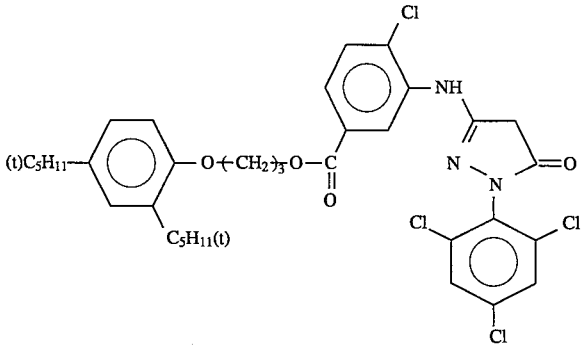

-continued
(m-14)
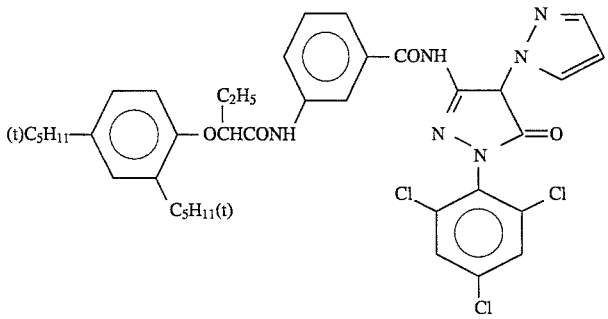
(m-15)
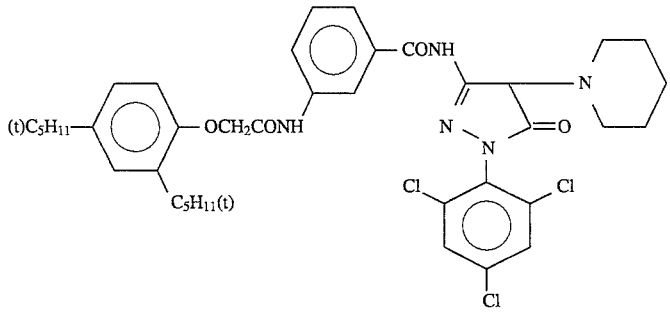
(m-16)
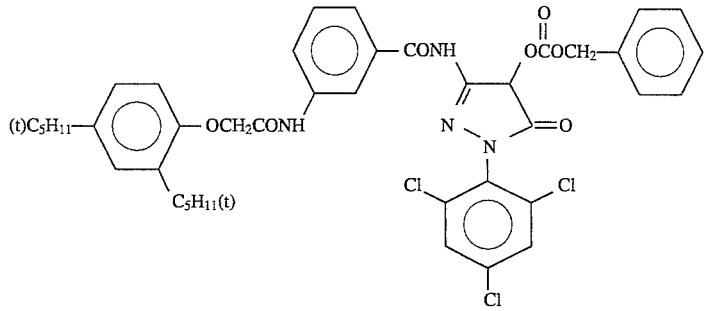
(m-17)
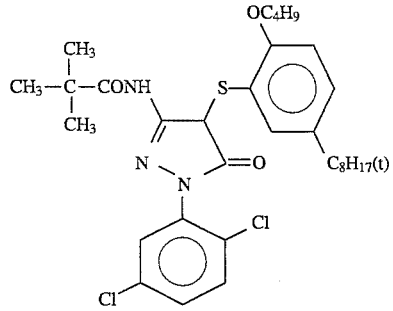
(m-18)
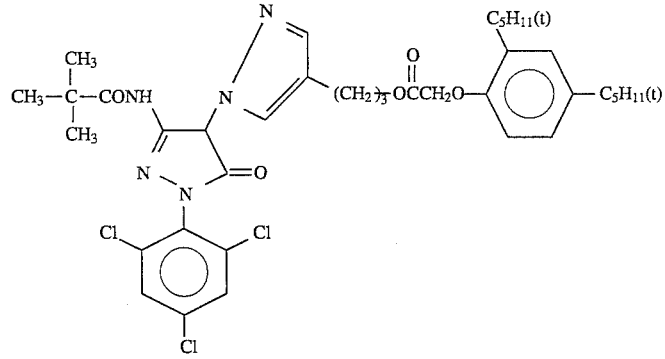

-continued
(m-19)
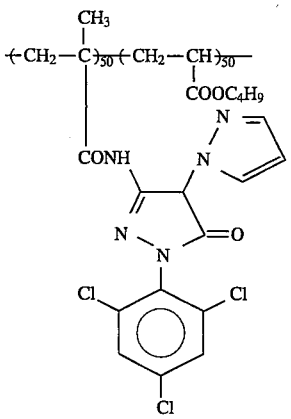
(by mol %)
(m-20)
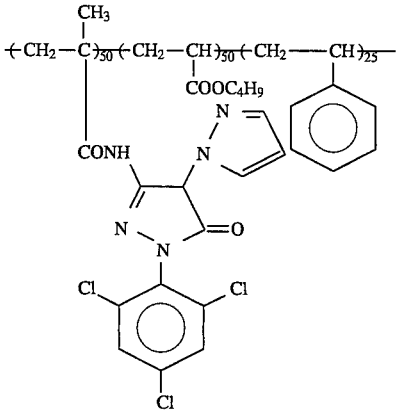
(by mol %)
(m-21)
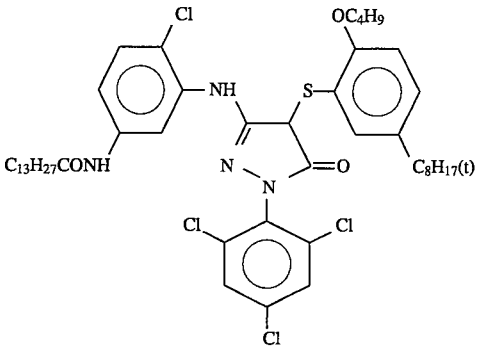
(m-22)
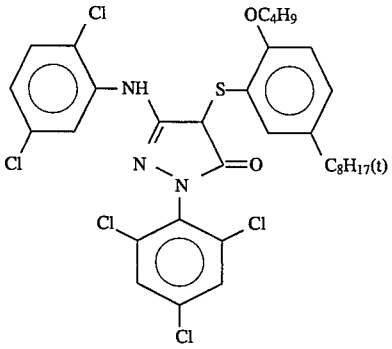

-continued
(m-23)
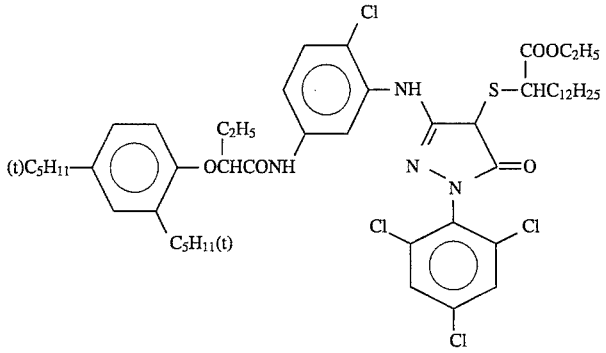
(m-24)
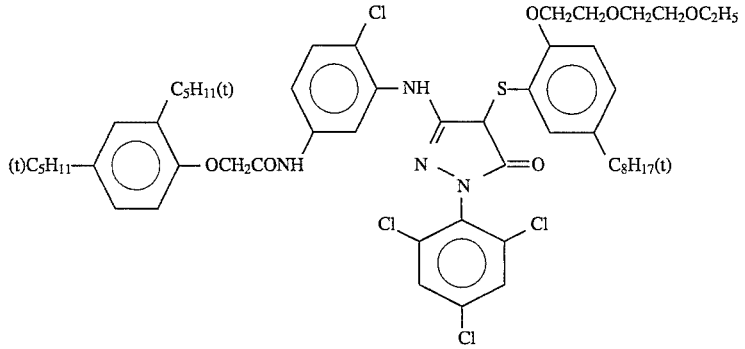
(m-25)
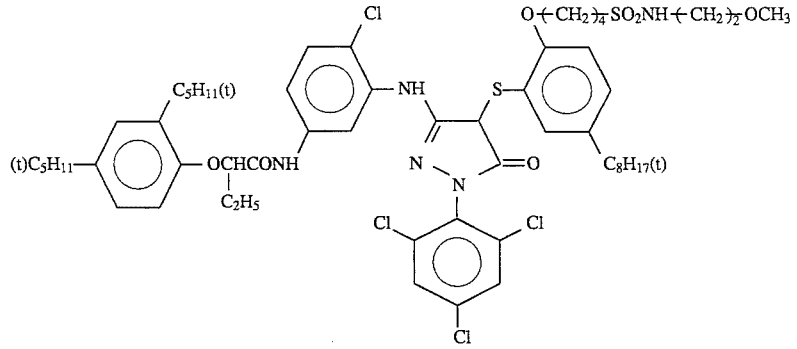
(m-26)
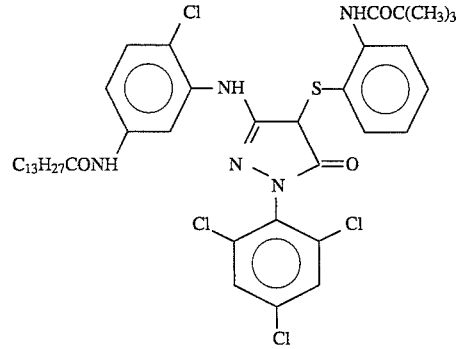

-continued
(m-27)
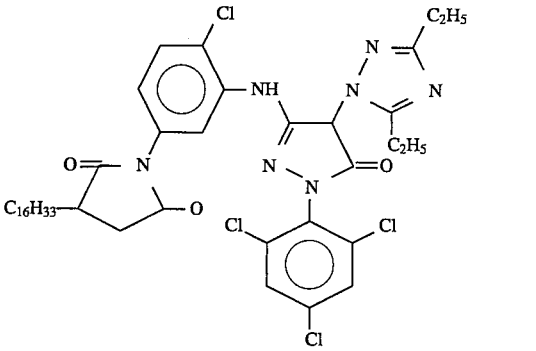
(m-28)
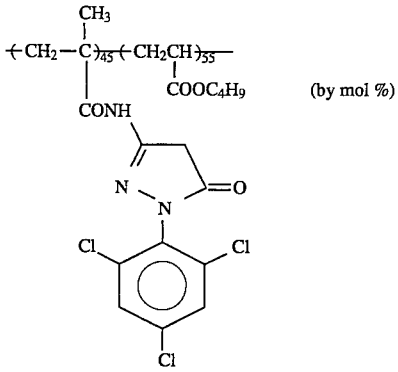
(by mol %)
(m-29)
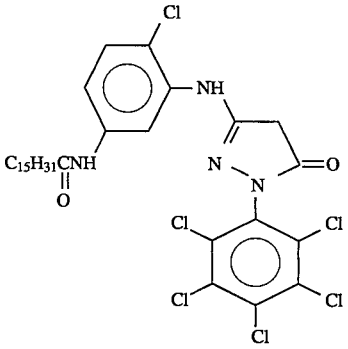
(m-30)
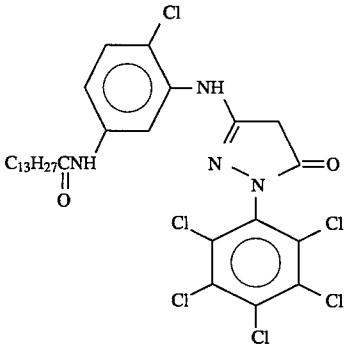

-continued (m-31)

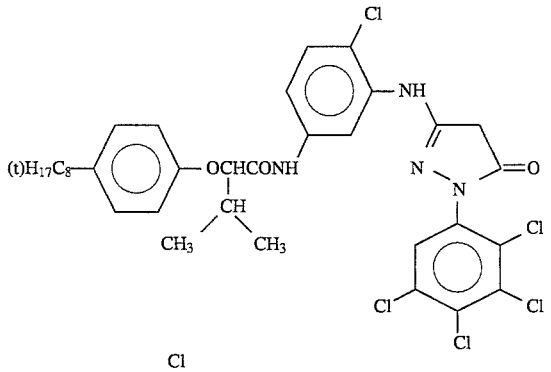

(m-32)

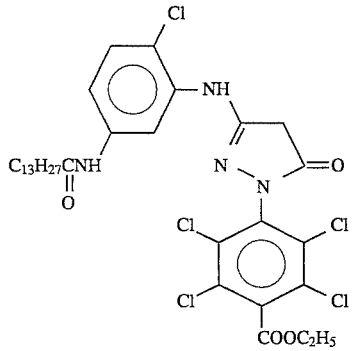

(m-33)

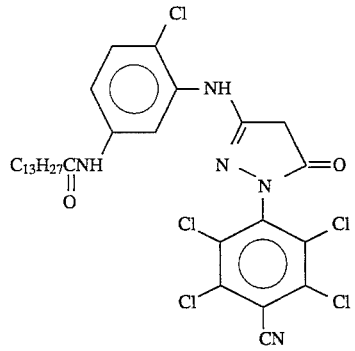

(m-34)

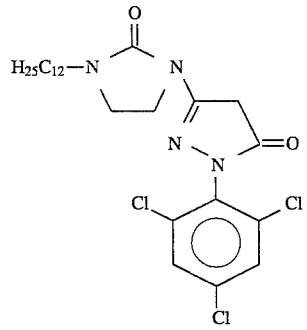

Arylthio-splitting-off couplers and azole-splitting-off couplers which are typical 2-equivalent couplers of the magenta couplers represented by the formula (m) may be produced according to the processes described in JP-A-57-35858 and JP-A-51-20826, respectively.

Various techniques and organic and inorganic materials employable in producing the silver halide photographic emulsions according to the present invention and also in producing silver halide photographic materials containing them are described in *Research Disclosure* No. 308119 (December 1989).

The present invention may be applied to various silver halide photographic materials. For example, they include black-and-white films, black-and-white printing papers, color negative films, color printing papers, color reversal films color reversal printing papers, color auto-positive films, color auto-positive printing papers and instant films.

Especially preferred are photographic materials for direct viewing, such as color reversal films, color reversal printing papers, color auto-positive films, color auto-positive printing papers and instant films. In particular, photographic materials to be developed by a so-called color reversal process are especially preferred, including, for example, color reversal films and color reversal printing papers.

According to the present invention, positive images are formed, for example, by a color reversal image-forming method comprising the following steps:

(1) Latent image are made of exposed silver halides by imagewise exposure.

(2) The exposed silver halides are developed by black-and-white development to form silver images.

(3) Latent images are made of silver halides remained in the non-exposed area by reversal treatment. Such reversal treatment may be conducted either by light-fogging treatment or by chemical fogging treatment using a foggant.

(4) The non-exposed silver halides are developed by color development to form color images.

(5) The silver images are removed by desilvering.

The color reversal development step will be explained more concretely hereunder.

The color reversal process to be employed in the present invention comprises any of the following steps, from black-and-white development to color development.

(1) black-and-white development—washing— reversal (chemical reversal)—color development (2) black-and-white development—washing— photo-reversal—color development (3) black-and-white development—washing—color development The washing step in the processes (1) to (3) may be replaced by a rinsing step as described in U.S. Pat. No. 4,804,616 so as to simplify the step and to reduce the amount of wastes from the step.

The process comprises any of the following steps, after color development.

(4) color development—compensation—bleaching—fixation—washing—stabilization (5) color development—washing—bleaching— fixation— washing—stabilization (6) color development—compensation—bleaching—washing—fixation—washing—stabilization (7) color development—washing—bleaching— washing—fixation—washing—stabilization (8) color development—bleaching—bleach-fixation—washing—stabilization (9) color development—bleaching—fixation— washing—stabilization

(10) color development—bleaching—bleach-fixation—stabilization

Anyone of the above-mentioned steps (1) to (3) is combined with anyone of the steps (4) to (10) to complete the color reversal process.

Processing solutions to be employed in the color reversal process of the present invention will be mentioned below.

In the present invention, it is preferred that at least one bath for the above-mentioned developing process has a pH of from 10.8 to 12.5 and a bromide content of from 0.005 mol/liter to 0.1 mol/liter. More preferably, the developing bath has a bromide content of from 0.008 mol/liter to 0.05 mol/liter, especially preferably from 0.01 mol/liter to 0.03 mol/liter. The bromide is preferably an alkali metal bromide, especially preferably potassium bromide or sodium bromide. If the pH in the bath is more than 12.5, such is not preferred in view of the stability of the processing solution therein.

According to the present invention, it is preferred that the bromide content of the developer in the black-and-white developing bath to be employed in the above-mentioned developing process is from 0.02 mol/liter to 0.1 mol/liter, more preferably from 0.03 mol/liter to 0.08 mol/liter, especially preferably from 0.03 mol/liter to 0.06 mol/liter. The bromide is preferably an alkali metal bromide, especially preferably potassium bromide or sodium bromide.

The essential processing steps constituting the color image-forming process of the present invention will be explained in more detail hereunder.

Black-and-White Development

The black-and-white developer to be used in the present invention contains developing agent. Examples of the developing agent include dihydroxybenzenes (e.g., hydroquinone, hydroquinone monosulfonate), 3-pyrazolidones (e.g., 1-phenyl-3-pyrazolidone, 1-phenyl-4-methyl-4 -hydroxymethyl-3-pyrazolidone), aminophenols (e.g., N-methyl-p-aminophenol), ascorbic acids, and condensed heterocyclic compounds composed of 1,2,3,4 -tetrahydroquinoline ring and indolenine ring (such as those described in U.S. Pat. No. 4,067,872). The developing agent may comprise two or more compounds. The amount of the developing agent to be in the black-and-white developer for use in the present invention is from $1\times10^{-5}$ to one mol per liter of the developer.

The black-and-white developer may contain, in addition to the developing agent, various additives such as a preservative (e.g., sulfites, bisulfites), a silver halide solvent, a buffer (e.g., carbonates, boric acid, borates, alkanolamines), an alkali agent (e.g., hydroxides, carbonates), a dissolution aid (e.g., polyethylene glycols, their esters), a pH adjusting agent (e.g., organic acids such as acetic acid), a sensitizer (e.g., quaternary ammonium salts), a development accelerator (e.g., thioether compounds), a surfactant, a defoaming agent, a hardening agent, a tackifier, an antifoggant, a swelling inhibitor (e.g., sodium sulfate, potassium sulfate), a chelating agent, etc.

Sulfites to be used as the preservative may also be used as the silver halide solvent. Examples of other silver halide solvents than sulfites include potassium thiocyanate, sodium thiocyanate, potassium thiosulfate, sodium thiosulfate and 2-methylimidazole. The amount of the silver halide solvent to be in the black-and-white developer is preferably from 0.005 to 0.02 mol, more preferably from 0.01 to 0.015 mol, as the thiocyanate ion, per liter of the developer. It is preferably from 0.05 to 1 mol, more preferably from 0.1 to 0.5 mol, as the sulfite ion, per liter of the developer.

Examples of the antifoggant include alkali metal halides (e.g., potassium bromide, sodium bromide, potassium iodide), nitrogen-containing heterocyclic compounds (e.g., benzotriazole, 6-nitrobenzimidazole, 5 -nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolidine), mercapto-substituted heterocyclic compounds (e.g., 1 -phenyl-5-mercaptotetrazole, 2-mercaptobenzimidazole, 2 -mercaptobenzothiazole) and mercapto-substituted aromatic compounds (e.g., thiosalicylic acid). Especially preferred are alkali metal bromides. The antifoggant may be added to the photographic material. In this case, the antifoggant dissolves out from the photographic material during black-and-white development to accumulate in the black-and-white developer. The amount of the antifoggant to be used is preferably from 0.001 mol to 0.1 mol, especially preferably from 0.01 mol to 0.05 mol, per liter of the black-and-white developer used.

Examples of the chelating agent include aminopolycarboxylic acids (e.g., ethylenediaminetetraacetic acid, hydroxyethyliminodiacetic acid, propylenediaminetetraacetic acid, diethylenetriaminepentaacetic acid, triethylenetetraminehexaacetic acid) and phosphonic acids (e.g., nitrilo-N,N,N-trimethylenephosphonic acid, ethylenediamine-N,N,N',N'-tetramethylenephosphonic acid, 1-hydroxyethylidene-1,1-diphosphonic acid). The chelating agent may contain two or more compounds. The amount of the chelating agent to be used is preferably from 0.1 g to 20 g, more preferably from 0.5 g to 10 g, per liter of the black-and-white developer used.

The pH value of the black-and-white developer to be used is preferably from 8.5 to 11.5, more preferably from 9.0 to 10.5. The amount of the replenisher for the black-and-white developer is preferably from 50 ml to 500 ml, more preferably from 50 ml to 330 ml, per $m^2$ of the photographic material being processed.

The processing time for black-and-white development is preferably from 20 seconds to 3 minutes, more preferably from 25 seconds to 75 seconds. The processing temperature for the same is preferably from 30° C. to 50° C., more preferably from 35° C. to 45° C.

After developed with a black-and-white developer, the photographic material is washed with water.

In the washing step, preferably used is a multi-stage countercurrent system comprising 2 or more tanks, so as to reduce the amount of the replenisher in the step. As the case may be, the amount of the replenisher may be reduced to the same level as those of the other processing bathes. To this case, applied is a rinsing bath. The amount of water to be replenished in the washing step is preferably from 3 liters to 20 liters per $m^2$ of the photographic material being processed. Where the rinsing bath is used, the amount of the replenisher to the bath is preferably from 50 ml to 2 liters, more preferably from 100 ml to 500 ml, per $m^2$ of the photographic material being processed. To the processing solution in the rinsing bath, may be added an oxidizing agent, a chelating agent, a buffer, a microbicide, etc., if desired.

Reversal Treatment

According to the color image-forming method of the present invention, the photographic material is subjected to reversal treatment after being processed for black-and-white development. The reversal step comprises a chemical-fogging step or a reversal-exposing step. The latter is preferred. In the former, used is a foggant such as tin ion-containing complexes, etc. The foggant may be added to the color developer mentioned below so as to carry out the reversal treatment and the color development in one and the same step. For the latter reversal-exposure, the whole surface of the photographic material being processed is exposed to light.

Color Development

The color developer to be used for color development is generally an alkaline aqueous solution containing an aromatic primary amine-type color developing agent. As the developing agent, preferred are p-phenylenediamine compounds. Examples of p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides, phosphates, p-toluenesulfonates, tetraphenylborates and p-(t-octyl)benzenesulfonates. The amount of the developing agent to be used is preferably from 1.0 g to 15 g, more preferably from 3.0 g to 8.0 g, per liter of the color developer.

The color developer may contain, in addition to the developing agent, a buffer (e.g., alkali metal carbonates, borates and phosphates), a preservative (e.g., hydroxylamine, diethylhydroxylamine, triethanolamine, catechol-3,5-disulfonates, sulfites, bisulfites), an organic solvent (e.g., diethylene glycol, triethylene glycol), a dye-forming coupler, a competing coupler (e.g., citrazinic acid, J acids, H acids), a nucleating agent (e.g., sodium boronhydride), an auxiliary developing agent (e.g., 1-phenyl-3-pyrazolidone), a tackifier, a development accelerator, an antifoggant, a chelating gent, etc. As examples of the antifoggant and the chelating agent, those mentioned for the above-mentioned black-and-white developer may be referred to.

Examples of the development accelerator include benzyl alcohol, pyridinium compounds (especially, those described in JP-B-44-9503—the term "JP-B" as referred to herein means an "examined Japanese patent publication", and U.S. Pat. No. 3,171,247), cationic dyes (e.g., phenosafranine), nitrates (e.g., thallium nitrate, potassium nitrate), polyethylene glycol and its derivatives (e.g., those described in JP-B-44-9304 and U.S. Pat. Nos. 2,533,990, 2,531,832, 2,577,127 and 2,950,970), polythioethers and thioether compounds (e.g., those described in U.S. Pat. No. 3,201,242). Especially preferred are thioether compounds. Thioether compounds are preferably in the color developer in an amount of from 0.1 to 10.0 g per liter of the developer.

The pH value of the color developer is preferably 9 or more, more preferably from 9.5 to 12.0, especially preferably from 10.0 to 11.5. The amount of the replenisher to the color developer is preferably from 50 ml to 500 ml, more preferably from 50 ml to 100 ml, per $m^2$ of the photographic material being processed.

The processing temperature for the color development is preferably from 30° C. to 50° C., more preferably from 31° C. to 45° C.

Desilvering Treatment

Desilvering treatment comprises a compensating step, a washing step, a bleaching step, a fixing step, a bleach-fixing step, a stabilizing step for a washing step, etc. Replenishment of the processing solution in each step may be effected by separately replenishing the processing solution to each bath. Where bleach-fixation is effected after bleaching, it is possible to lead the overflow from the bleaching bath to the next bleach-fixing bath while only a fixer is replenished to the bleach-fixing bath.

As the bleaching agent to be used in the bleaching step or bleach-fixing step, typically mentioned are iron(III) complexes of aminopolycarboxylic acids. Preferred examples of the bleaching agent include ethylenediaminetetraacetic acid, disodium ethylenediaminetetraacetate, diammonium ethylenediaminetetraacetate, diethylenetriaminepentaacetic acid, cyclohexanediaminetetraacetic acid, disodium cyclohexanediaminetetraacetate, iminodiacetic acid and 1,3-diaminopropanetetraacetic acid.

Iron(III) complexes of aminopolycarboxylic acids may be formed in the processing solution by adding an iron(III) salt and an aminopolycarboxylic acid to the solution. Two or more aminopolycarboxylic acids may be used together. If desired, an excess of aminopolycarboxylic acid(s) may be used in forming iron(III) complexes therewith. In addition to iron(III) complexes, complexes of other metals than iron, such as cobalt, copper, etc., may also be added to the bleaching solution or the bleach-fixing solution.

The amount of the bleaching agent to be in the bleaching solution is preferably from 0.1 mol to 1 mol, more preferably from 0.2 mol to 0.5 mol, per liter of the solution. The pH of the bleaching solution is preferably from 4.0 to 8.0, more preferably from 5.0 to 6.5.

The amount of the bleaching agent to be in the bleach-fixing solution is preferably from 0.05 mol to 0.5 mol, more preferably from 0.1 mol to 0.3 mol, per liter of the solution. The pH of the bleach-fixing solution is preferably from 5 to 8, more preferably from 6 to 7.5.

A bleaching accelerator may be added to the bleaching bath, the bleach-fixing bath of the compensating bath. Examples of the bleaching accelerator include mercapto compounds (such as those described in JP-A-53 -141623, U.S. Pat. No. 3,893,858 and British Patent 1,138,842), disulfido bond-having compounds (such as those described in JP-A-53-95630), thiazolidine derivatives (such as those described in JP-B-53-9854), isothiourea derivatives (such as those described in JP-A-53-94927), thiourea derivatives (such as those described in JP-B-45 -8506 and JP-B-49-26586), thioamide compounds (such as those described in JP-A-49-42349), dithiocarbamates (such as those described in JP-A-55-26506) and alkylmercapto compounds (e.g., trithioglycerin, α,α'-thiodipropionic acid, δ-mercaptobutyric acid). The above-mentioned alkylmercapto compounds may have one or more substituents selected from among a hydroxyl group, a carboxyl group, a sulfonic acid group, an amino group, etc. The amino group may be substituted by one or more substituents selected from among an alkyl group, an acetoxyalkyl group, etc.

The amount of the bleaching accelerator to be used is determined, in consideration of the kind of the photographic material to be processed, the processing temperature and the processing time. Where mercapto compounds, disulfido bond-having compounds, thiazolidine derivatives and isothiourea derivatives are used as the bleaching accelerator, the amount of the bleaching accelerator to be in the processing solution is preferably from $10^{-5}$ mol to $10^{-1}$ mol, more preferably from $10^{-4}$ mol to $5\times10^{-2}$ mol, per liter of the solution.

The bleaching solution may contain, in addition to the bleaching agent and the bleaching accelerator, a re-halogenating agent as well as inorganic acids, organic acids and their salts having a pH-buffering capacity. Examples of the re-halogenating agent include bromides (e.g., potassium bromide, sodium bromide, ammonium bromide) and chlorides (e.g., potassium chloride, sodium chloride, ammonium chloride). Examples of acids and their salts having a pH-buffering capacity include nitrates (e.g., sodium nitrate, ammonium nitrate), boric acid, borax, sodium metaborate, acetic acid, sodium acetate, sodium carbonate, potassium carbonate, phosphorous acid, phosphoric acid, sodium phosphate, citric acid, sodium citrate and tartaric acid.

Examples of the fixing agent to be used in the fixing step and the bleach-fixing step include thiosulfates (e.g., sodium thiosulfate, ammonium thiosulfate), thiocyanates (e.g., sodium thiocyanate, ammonium thiocyanate, potassium thiocyanate), thioureas and thioethers.

The amount of the fixing agent to be in the bleach-fixing solution is preferably from 0.3 mol to 3 mols, more preferably from 0.5 mol to 2 mols, per liter of the solution.

The amount of the fixing agent to be in the fixing solution is preferably from 0.5 mol to 4 mols, preferably from 1 mol to 3 mols, per liter of the solution. The pH value of the fixing solution is preferably from 6 to 10, more preferably from 7 to 9.

The fixing solution and the bleach-fixing solution may further contain known additives such as sulfites, bisulfites, a buffering agent, a chelating agent, sulfinic acids, etc. If desired, ammonium halides (e.g., ammonium bromide) and alkali metal halides (e.g., sodium bromide, sodium iodide) may be added to the fixing solution and the bleach-fixing solution. Where the fixing solution and the bleach-fixing solution are diluted with the overflow from the bleaching bath, it is preferred that the components in the fixing solution and the bleach-fixing solution are made to have relatively high concentrations. Considering the dilution with the overflow, the amounts of the waste exhaust liquids may be reduced and the load for recovering and treating the liquids may be reduced.

The amounts of the replenishers to the bleaching solution, the fixing solution and the bleach-fixing solution each are preferably from 30 ml to 900 ml, more preferably from 50 ml to 150 ml, per $m^2$ of the photographic material being processed.

The desilvering needs a washing step or a stabilizing step in place of a washing step, as the final step.

Water to be used in the washing step may contain known additives, if desired. Examples of additives thereto include a chelating agent (e.g., inorganic phosphoric acids, aminopolycarboxylic acids, organic phosphoric acids), a microbicide, an anti-fungal agent, a hardening agent and a surfactant. Two or more tanks may be used in the washing step. If desired, the amount of water for the washing step may be reduced by employing a multi-stage countercurrent washing system (for example, having 2 to 9 stages).

The stabilizing solution to be used in the stabilizing step employable in place of the washing step is effective in stabilizing color images formed. Examples of the stabilizing solution include a solution having a pH value of from 3 to 6 and having a buffering capacity and a solution containing an aldehyde (e.g., formaldehyde). The stabilizing solution may contain, if desired, a chelating agent, a microbicide, an anti-fungal agent, a hardening agent, a surfactant, etc. In the stabilizing step employable in place of the washing step, two or more tanks may be used. If desired, the amount of the stabilizing solution for the step may be reduced by employing a multi-stage countercurrent system (for example, having 2 to 9 stages).

The baths for the above-mentioned steps may be equipped with heaters, temperature sensors, liquid level sensors, circulating pumps, filters, floating lids, squeegees, nitrogen-stirring devices, air-stirring devices, etc.

The present invention will be explained in more detail with reference to the following examples.

EXAMPLE 1

Preparation of Sample No. 101

The following first layer to ninth layer were coated on the front surface of a paper support (thickness: 100 microns) laminated with polyethylene on both its surfaces, while the following tenth layer and eleventh layer on the back surface thereof, to prepare a multi-layered color photographic material. The polyethylene below the first layer contained titanium oxide (4 g/$m^2$) as a white pigment along with a small amount (0.003 g/$m^2$) of ultramarine as a blue-coloring dye. (The chromaticity of the front surface of the support was represented by 88.0, −0.20 and −0.75, respectively, as the colorimetric system L*-a*-b*.)

(Compositions of Photographic Layers)

The components in each photographic layer and their amounts (as unit of g/$m^2$) are shown below. The amount of the sensitizing dye is represented by mol thereof per mol of silver. The amount of the silver halide is represented by that of silver therein. Emulsions used in these layers were prepared by the same method as that for preparing Emulsion (EM-1) mentioned below, except that the temperatures were varied to change the grain sizes. The emulsion in the eleventh layer was a Lippmann emulsion not chemically sensitized on the surfaces of the grains therein.

| | |
|---|---|
| First Layer (Anti-halation Layer): | |
| Black Colloidal Silver | 0.10 |
| Color Mixing Preventing Agent (Cpd-7) | 0.05 |
| Solvent for Color Mixing Preventing Agent (1/1 by weight of Solv-4, 5) | 0.12 |
| Gelatin | 0.70 |
| Second Layer (Interlayer): | |
| Gelatin | 0.70 |
| Dye (Cpd-32) | 0.005 |
| Third Layer (Red-sensitive Layer): | |
| Octahedral Grains of Silver Bromide (mean grain size: 0.40 μm, grain size distribution: 10%) color-sensitized with red-sensitizing dyes (1/1/1 by weight of ExS-1, 2, 3, totaling $5.4 \times 10^{-4}$) | 0.25 |
| Gelatin | 0.70 |
| Cyan Couplers (1/1/0.2 by weight of ExC-1, 2, 3) | 0.30 |
| Anti-fading Agent (1/1/1/1/1 by weight of Cpd-1, 2, 3, 4, 30) | 0.18 |
| Anti-staining Agent (1/1 by weight of Cpd-5, 15) | 0.003 |
| Coupler-dispersing Medium (Cpd-6) | 0.30 |
| Coupler Solvent (1/1/1 by weight of Solv-1, 3, 5) | 0.12 |
| Fourth Layer (Interlayer): | |
| Gelatin | 1.003 |
| Color-Mixing Preventing Agent (Cpd-7) | 0.08 |
| Solvent for Color Mixing Preventing Agent (1/1 by weight of Solv-4, 5) | 0.16 |
| Polymer Latex (Cpd-8) | 0.10 |
| Fifth Layer (Green-sensitive Layer): | |
| Octahedral Grains of Silver Bromide (mean grain size: 0.40 μm, grain size distribution: 10%) color-sensitized with green-sensitizing dye (ExS-4: $2.6 \times 10^{-4}$) | 0.20 |
| Gelatin | 1.00 |
| Magenta Couplers (1/1 by weight of ExM-1, 2) | 0.11 |
| Yellow Coupler (ExY-1) | 0.03 |
| Anti-fading Agent (1/1/1/1 by weight of Cpd-9, 26, 30, 31) | 0.15 |
| Anti-staining Agent (10/7/7/1 by weight of Cpd-10, 11, 12, 13) | 0.025 |
| Coupler-dispersing Medium (Cpd-6) | 0.05 |
| Coupler Solvent (1/1 by weight of Solv-4, 6) | 0.15 |
| Sixth Layer (Interlayer): | |
| Same as Fourth Layer. | |
| Seventh Layer (Blue-sensitive Layer): | |
| Octahedral Grains of Silver Bromide (mean grain size: 0.60 μm, grain size distribution: 11%) color-sensitized with blue-sensitizing dyes (1/1 by weight of ExS-5, 6, totaling $3.5 \times 10^{-4}$) | 0.32 |
| Gelatin | 0.80 |
| Yellow Couplers (1/1 by weight of ExY-2, 3) | 0.35 |
| Anti-fading Agent (Cpd-14) | 0.10 |
| Anti-fading Agent (Cpd-30) | 0.05 |
| Anti-staining Agent (1/5 by weight of Cpd-5, 15) | 0.007 |
| Coupler Solvent (Solv-2) | 0.15 |
| Eighth Layer (Ultraviolet Absorbent-containing Layer): | |
| Gelatin | 0.60 |
| Ultraviolet Absorbent (1/1/1 by weight of Cpd-2, 4, 16) | 0.40 |
| Color Mixing Preventing Agent (1/1 by weight of Cpd-7, 17) | 0.03 |
| Dispersing Medium (Cpd-6) | 0.02 |
| Solvent for Ultraviolet Absorbent (1/1 by weight of Soly-2, 7) | 0.08 |
| Anti-irradiating Agent (10/10/13/15/20 by weight of Cpd-18, 19, 20, 21, 27) | 0.05 |

-continued

| | |
|---|---|
| Ninth Layer (Protective Layer): | |
| Fine Grains of Silver Iodobromide (silver bromide content: 99 mol %, mean grain size: 0.05 μm) | 0.03 |
| Acryl-modified Copolymer of Polyvinyl Alcohol (molecular weight: 50,000) | 0.01 |
| 1/1 Mixture of Polymethyl Methacrylate Grains (mean grain size: 2.4 μm) and Silicone Oxide Grains (mean grain size: 5 μm) | 0.05 |
| Gelatin | 0.05 |
| Gelatin Hardening Agent (1/1 by weight of H-1, 2) | 0.18 |
| Tenth Layer (Backing Layer): | |
| Gelatin | 2.50 |
| Ultraviolet Absorbent (1/1/1 by weight of Cpd-2, 4, 16) | 0.50 |
| Dyes (1/1/1/1 by weight of Cpd-18, 19, 20, 27) | 0.06 |
| Eleventh Layer (Protective Layer for Backing Layer): | |
| 1/1 Mixture of Polymethyl Methacrylate Grains (mean grain size: 2.4 μm) and Silicone Oxide Grains (mean grain size: 5 μm) | 0.05 |
| Gelatin | 2.00 |
| Gelatin Hardening Agent (1/1 by weight of H-1, 2) | 0.14 |

Preparation of Emulsion (EM-1)

An aqueous solution of potassium bromide and an aqueous solution of silver nitrate were simultaneously added to an aqueous gelatin solution, while vigorously stirring at 65° C., over a period of 15 minutes to obtain octahedral silver bromide grains having a mean grain size of 0.23 μm. In preparing the grains, 0.3 g, per mol of silver, of 3,4-dimethyl-1,3-thiazoline-2-thione were added thereto. 6 mg, per mol of silver, of sodium thiosulfate and 7 mg, per mol of silver, of chloroauric acid (4 -hydrate) were added to the emulsion in this order and then heated at 75° C. for 80 minutes to thereby chemically sensitize it. The cores thus obtained were grown under the same precipitation condition as that in the first step to finally obtain a monodisperse emulsion of octahedral core/shell silver bromide grains having a mean grain size of 0.4 μm. The fluctuation coefficient of the grain size was about 10%. To this emulsion, added were 1.5 mg, per mol of silver, of sodium thiosulfate and 1.5 mg, per mol of silver, of chloroauric acid (4-hydrate) and heated at 60° C. for 60 minutes to thereby chemically sensitize the emulsion. Accordingly, an internal latent image type silver halide emulsion was obtained.

The above-mentioned light-sensitive layers contained a nucleating agent comprising $10^{-3}$ wt. % and $10^{-2}$ wt. %, relative to the silver halide, of ExZK-1 and ExZK-2, respectively, and a nucleation accelerator comprising Cpd- 22, Cpd-28 and Cpd-29 of $10^{-2}$ wt. % each. In addition, these layer further contained an emulsification and dispersion aid comprising Alkanol XC (made by Du Pont Co.) and sodium alkylbenzenesulfonate along with a coating aid comprising succinate and Magefac F-120 (made by Dai-Nippon ink Co.). A stabilizer (1/1/1 by weight of Cpd-23, 24, 25) was added to the silver halide-containing layers and the colloidal silver-containing layer. The total thickness of the film (containing light-sensitive layers) coated on the front surface of the support was 10.2 μm. The sample thus prepared was referred to as Sample No. 101. Compounds used in this example are mentioned below.

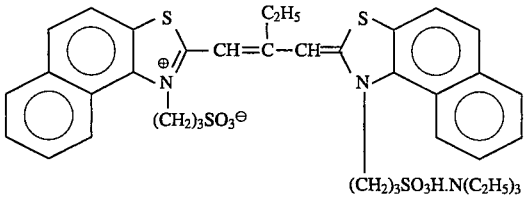
ExS-1
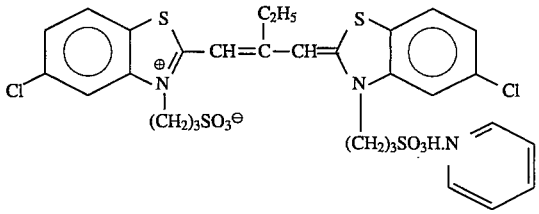
ExS-2
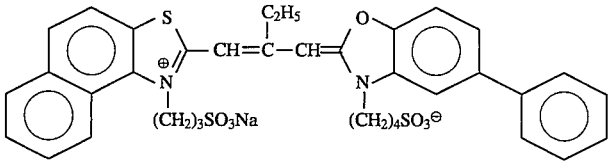
ExS-3
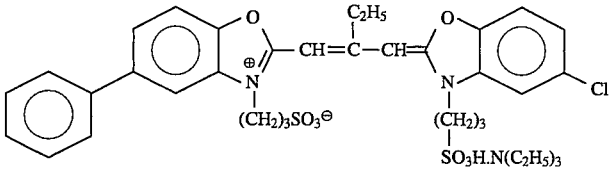
ExS-4
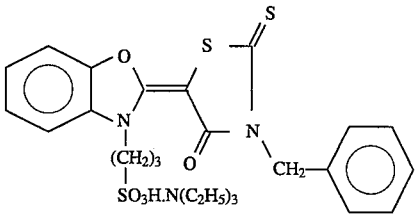
ExS-5
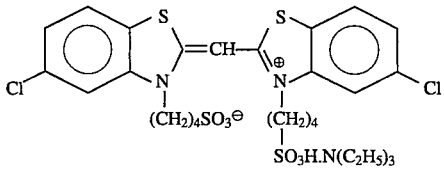
ExS-6
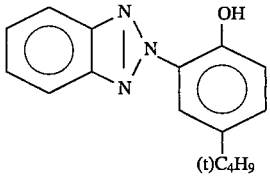
Cpd-1
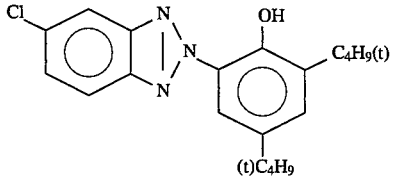
Cpd-2

-continued
Cpd-3
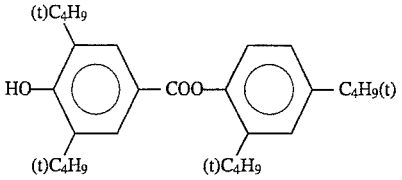
Cpd-4
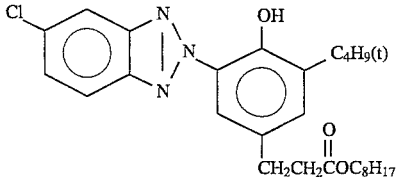
Cpd-5
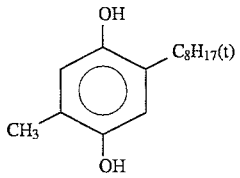
Cpd-6
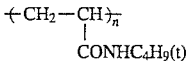
(n = 100 ~ 1000)
Cpd-7
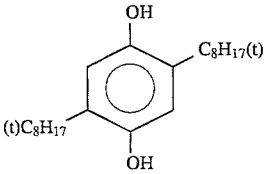
Cpd-8
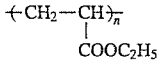
(n = 100–1000)
Cpd-9
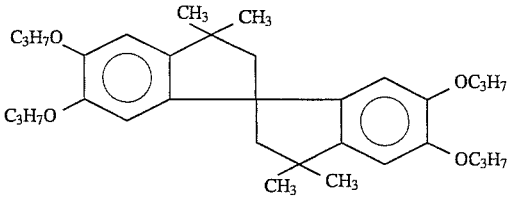
Cpd-10
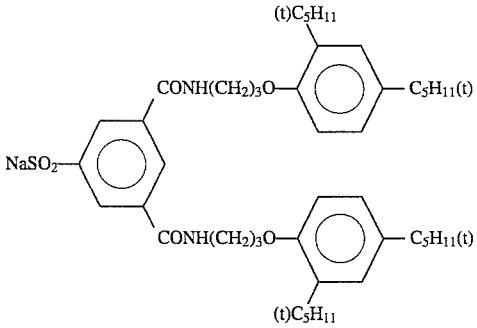

-continued
Cpd-11
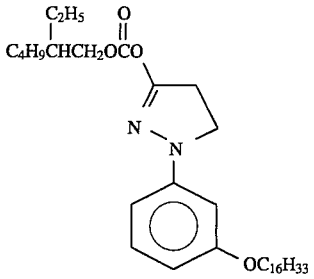
Cpd-12
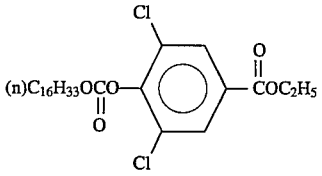
Cpd-13
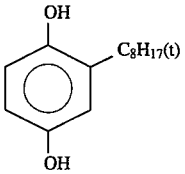
Cpd-14
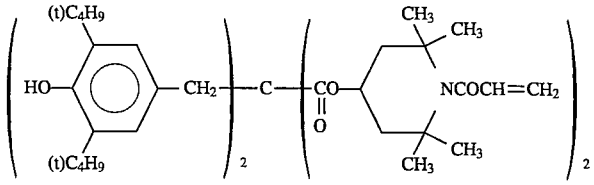
Cpd-15
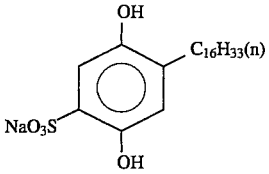
Cpd-16
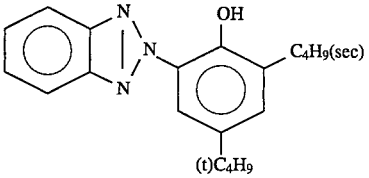
Cpd-17
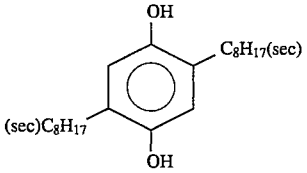
Cpd-18
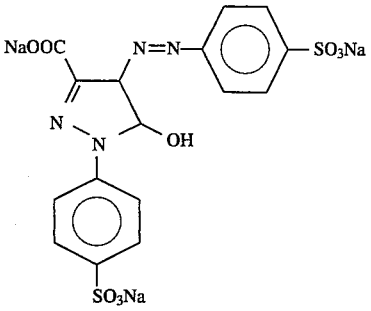

-continued
Cpd-19
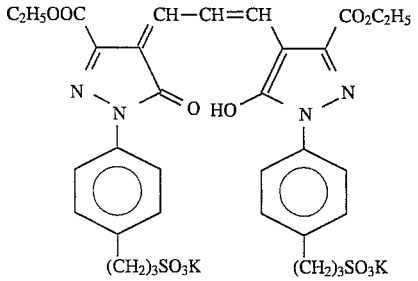
Cpd-20
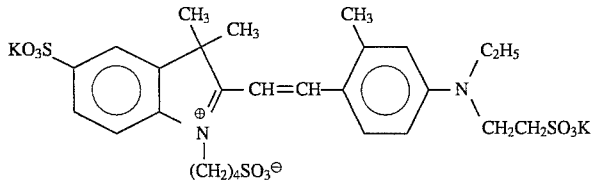
Cpd-21
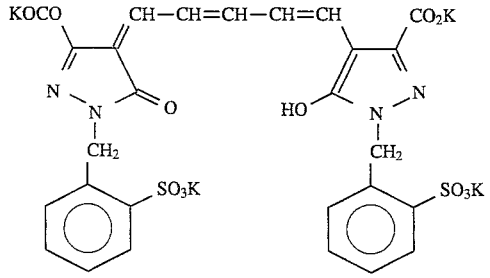
Cpd-22
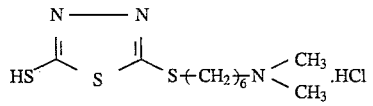
Cpd-23
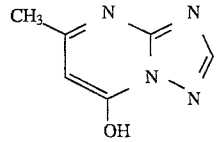
Cpd-24
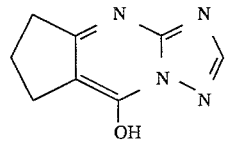
Cpd-25
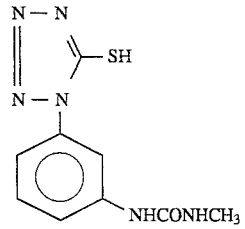
Cpd-26
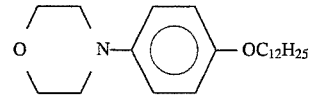
Cpd-27
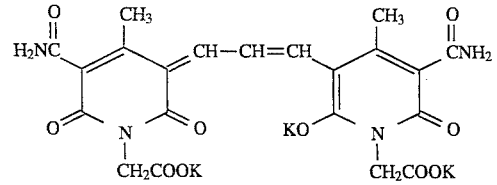

-continued
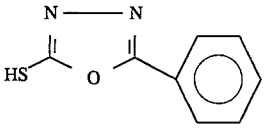
Cpd-28
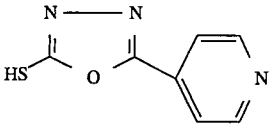
Cpd-29
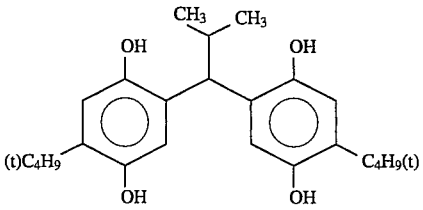
Cpd-30
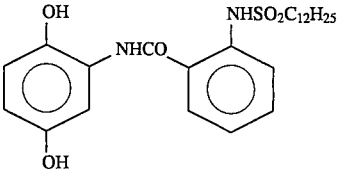
Cpd-31
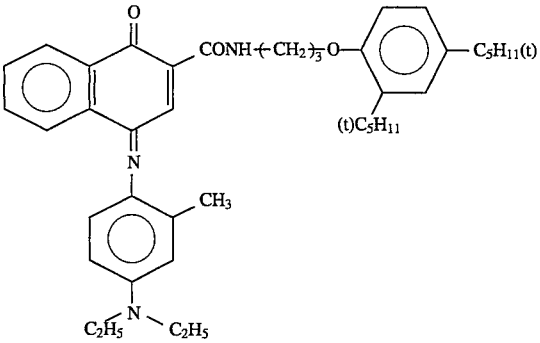
Cpd-32
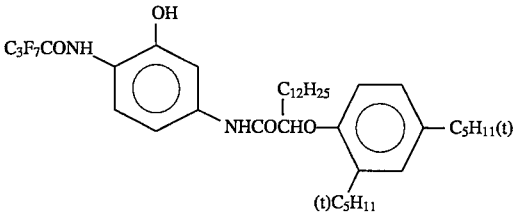
ExC-1
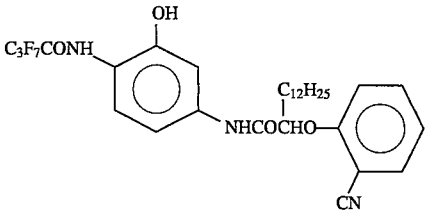
ExC-2
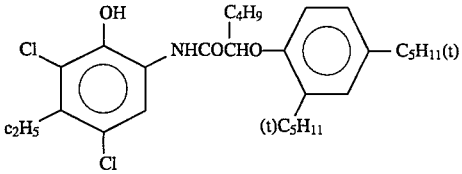
ExC-3

-continued
ExM-1
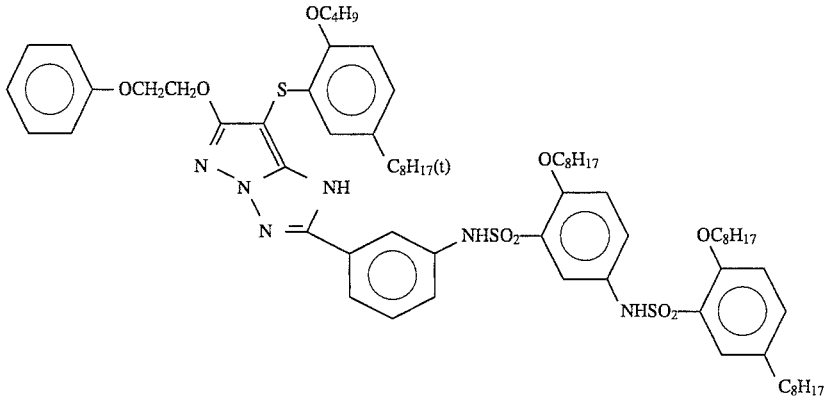
ExM-2
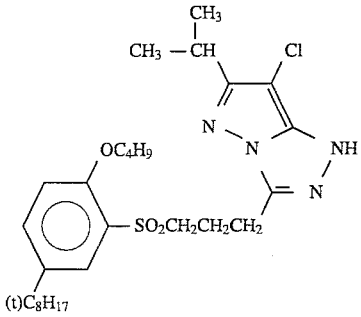
ExY-1
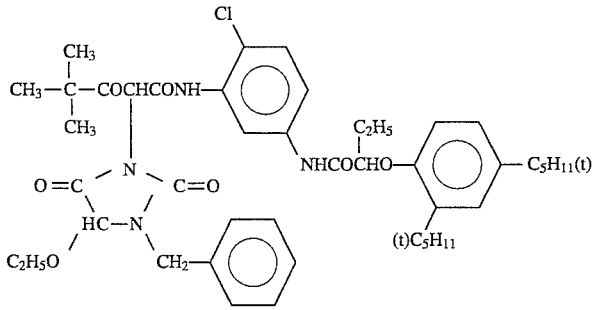
ExY-2
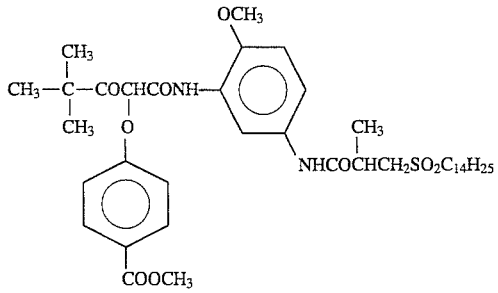
ExY-3
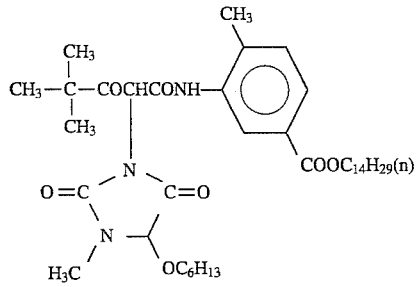
Solv-1
Di(2-ethylhexyl) Sebacate
Solv-2
Trinonyl Phosphate
Solv-3
Di(3-methylhexyl) Phthalate Solv-4
Tricresyl Phosphate
Solv-5
Dibutyl Phthalate
Solv-6
Trioctyl Phosphate
Solv-7
Di(2-ethylhexyl) Phthalate
H-1
1,2-Bis(vinylsulfonylacetamido)ethane
H-2
4,6-Dichloro-2-hydroxy-1,3,5-triazine Na Salt
ExZK-1
7-(3-Ethoxythiocarbonylaminobenzamido)-9-methyl-10-propargyl-1,2,3,4-tetrahydroacridinium Trifluoromethanesulfonate
ExZK-2
2-[ 4-{ 3-[ 3-{ 3-[ 5-{ 3-[ 2-chloro-5-(1 -dodecyloxycarbonylethoxycarbonyl)phenylcarbamoyl]-4-hydroxy-1-naphthylthio}tetrazol-1-yl]phenyl}ureido]benzensulfonamido} phenyl]-1-formylhydrazine Samples Nos. 102 to 113 were prepared in the same manner as in preparation of Sample No. 101, except that a part of the coupler solvent (Solv-2) in the seventh layer (blue-sensitive layer) was replaced by a compound according to the present invention or a comparative compound, as indicated in Table 1 below, while the weight of the coupler solvent was made the same in all the samples.

Sample Nos. 101 to 113 prepared in the manner mentioned above were exposed via a black-and-white separation screen positive.

Each sample was subjected to red exposure (using SC-60 filter, made by Fuji Photo Film Co., Ltd.) with a cyan-and-black positive black-and-white dot image film being kept into contact therewith; then it was subjected to green exposure (using BPN-53 Filter, made by Fuji Photo Film Co., Ltd.) via a magenta-and-black positive black-and-white dot image film; and thereafter it was subjected to blue exposure (using BPN-45 Filter and SC-42 Filter, both made by Fuji Photo Film Co., Ltd.) via an yellow-and-black positive black-and-white dot image film.

The thus-exposed samples were processed according to the process (A) mentioned below, to obtain dot color images.

Process (A):

| Step | Time (sec) | Temp. (°C.) | Tank Capacity (liter) | Amount of Replenisher (ml/m$^2$) |
|---|---|---|---|---|
| Color Development | 135 | 38 | 28 | 240 |
| Bleach-fixation | 60 | 34 | 11 | 340 |
| Washing (1) | 40 | 32 | 7 | — |
| Washing (2) | 40 | 32 | 7 | 240 |
| Drying | 30 | 80 | | |

A so-called countercurrent system was employed to replenish the washing water, in which the washing water was replenished to the washing bath (2) and the overflow from the washing bath (2) was led to the washing bath (1). The carryover of each processing solution to the next bath was 35 ml per m$^2$ of the sample being processed.

Compositions of the processing solutions used above are mentioned below.

| Components | Tank Solution | Replenisher |
|---|---|---|
| Color Developer (A): | | |
| D-sorbitol | 0.15 g | 0.20 g |
| Sodium Naphthalenesulfone/Formalin Condensate | 0.15 g | 0.2 g |
| Pentasodium Nitrilotris(methylenephosphonate) | 1.8 g | 1.8 g |
| Diethylenetriaminepentaacetic Acid | 0.5 g | 0.5 g |
| 1-Hydroxyethylidene-1,1-diphosphonic Acid | 0.15 g | 0.15 g |
| Diethylene Glycol | 12.0 ml | 16.0 ml |
| Benzyl Alcohol | 14.0 ml | 18.5 ml |
| Potassium Bromide | 0.70 g | — |
| Benzotriazole | 0.005 g | 0.007 g |
| Sodium Sulfite | 5.6 g | 7.4 g |
| Hydroxylamine 1/2 Sulfate | 4.5 g | 6.0 g |
| Triethanolamine | 6.0 g | 8.0 g |
| 4-[N-ethyl-,N-(β-hydroxyethyl)amino]aniline Sulfate 1/2 Hydrate | 4.2 g | 5.6 g |
| Potassium Carbonate | 30.0 g | 25.0 g |
| Brightening Agent (diaminostilbene compound) | 1.3 g | 1.7 g |
| Water to make | 1000 ml | 1000 ml |
| pH at 25° C. (adjusted with KOH or sulfuric acid) | 10.30 | 10.75 |
| Bleach-fixing Solution: | | |
| Disodium Ethylenediaminetetraacetate Dihydrate | 4.0 g | 4.0 g |
| Ammonium Ethylenediaminetetraacetato Ferrate Dihydrate | 55.0 g | 55.0 g |
| Ammonium Thiosulfate (750 g/liter) | 168 ml | 168 ml |
| Sodium P-toluenesulfinate | 30.0 g | 30.0 g |
| Ammonium Sulfite | 35.0 g | 37.0 g |
| 3-Mercapto-1,2,4-triazole | 0.5 g | 0.5 g |
| Ammonium Sulfate | 10.0 g | 10.0 g |
| Water to make | 1000 ml | 1000 ml |
| pH at 25° C. (adjusted with aqueous ammonia or acetic acid) | 6.20 | 6.10 |
| Washing Water: | | |
| | Tank Solution, Replenisher | |
| Sodium Chloroisocyanurate | 0.02 g | |
| Deionized Water (electroconductivity: 5 μs/cm or less) | 1000 ml | |

The cyan density in the yellow-monochromatic area in the dot image formed in each sample was measured with X-rite, by which the degree of yellow turbidity was evaluated. The yellow stain density in the white background area of each of the fresh samples (immediately after development) and the aged samples (stored at 50° C. and 80% RH for 24 hours after development) was measured, and the increase in the measured density between the fresh samples and the aged samples was calculated. Thus, the increase in the stain density immediately after development was obtained, by which the anti-staining property of each sample was evaluated. The results obtained are shown in Table 1.

TABLE 1

| Sample No. | | Coupler Solvent in 7th Layer: Compound | Substituted Amount (%, relative to Solv-2) | Cyan Component (DC) in Yellow Area | Increase in Stain in White Background with the Lapse of Time ($\Delta D_B$) |
|---|---|---|---|---|---|
| 101 | comparative sample | (Solv-2) | (100) | 0.07 | 0.03 |
| 102 | sample of the invention | S-5 | 5 | 0.01 | 0.01 |
| 103 | sample of the invention | S-5 | 10 | 0.00 | 0.00 |
| 104 | sample of the invention | S-5 | 20 | 0.00 | 0.00 |
| 105 | sample of the invention | S-5 | 40 | 0.00 | 0.01 |
| 106 | sample of the invention | S-1 | 20 | 0.01 | 0.01 |
| 107 | sample of the invention | S-7 | 20 | 0.00 | 0.00 |
| 108 | sample of the invention | S-8 | 20 | 0.00 | 0.00 |
| 109 | sample of the invention | S-10 | 20 | 0.01 | 0.00 |
| 110 | sample of the invention | S-14 | 20 | 0.02 | 0.01 |
| 111 | sample of the invention | S-16 | 20 | 0.00 | 0.00 |
| 112 | comparative sample | cf-59 | 20 | 0.07 | 0.03 |
| 113 | comparative sample | cf-62 | 20 | 0.06 | 0.03 |

Compounds (cf-59) and (cf-62) shown in the above table are mentioned below. These are diphosphates not falling within the scope of the compounds represented by the formula (1) according to the present invention, and these were disclosed in EP-A-553964 as Compound (59) and Compound (62), respectively.

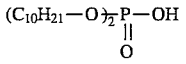

cf-59

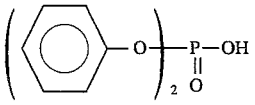

cf-62

As is noted from the results in Table 1 above, Sample No. 101 had an extremely high cyan density in the yellow area and the color in the yellow area was turbid. As opposed to this, Sample Nos. 102 to 111 each containing the compound according to the present invention had almost no cyan component in the yellow area. On the other hand, it is also noted from the same table that Sample No. 112 having a diphosphate (this is a diphosphate solid at 25° C. and is different from the compound according to the present invention in that $R_1$ and $R_2$ in the formula (1) are both linear alkyl groups) and Sample No. 113 also having a diphosphate different from the compound according to the present invention in that $R_1$ and $R_2$ in the formula (1) are both aryl groups were not improved. Regarding the increase in the stain density in the white background area immediately after development, Sample Nos. 101, 112 and 113 (comparative samples) had an increased stain density immediately after development while the increase in the stain density in Sample Nos. 102 to 111 of the present invention was almost negligible.

EXAMPLE 2

Preparation of Sample No. 201

Plural layers each having the composition mentioned below were coated on a subbing layer-coated cellulose triacetate film support (thickness: 127 μm) to prepare a multi-layered color photographic material sample, which was referred to as Sample No. 201. In the following compositions, the amount of each component coated is per $m^2$. The effect of the compound added is not limited to the use described.

| | |
|---|---|
| First Layer: Anti-halation Layer | |
| Black Colloidal Silver | 0.3 g |
| Gelatin | 2.2 g |
| Ultraviolet Absorbent U-1 | 0.1 g |
| Ultraviolet Absorbent U-3 | 0.05 g |
| Ultraviolet Absorbent U-4 | 0.1 g |
| High Boiling Point Organic Solvent Oil-1 | 0.1 g |
| Dispersion of Fine Crystalline Solid of Dye E-1 | 0.1 g |
| Second Layer: Interlayer | |
| Gelatin | 0.40 g |
| Compound Cpd-C | 5 mg |
| Compound Cpd-J | 3 mg |
| Compound Cpd-K | 3 mg |
| High Boiling Point Organic Solvent Oil-3 | 0.1 g |
| Dye D-4 | 9 mg |
| Third Layer: Interlayer | |
| Emulsion of Fine Silver Iodobromide Grains fogged in both the surface and the inside (mean grain size: 0.06 μm, fluctuation coefficient: 18%, AgI content: 1 mol %) | 0.05 g as Ag |
| Gelatin | 0.4 g |
| Fourth Layer: Low-sensitivity Red-sensitive Emulsion Layer | |
| Emulsion A | 0.5 g as Ag |

-continued

| | |
|---|---|
| Emulsion B | 0.3 g as Ag |
| Gelatin | 0.8 g |
| Coupler C-1 | 0.1 g |
| Coupler C-2 | 0.25 g |
| Coupler C-3 | 0.1 g |
| Compound Cpd-C | 5 mg |
| Compound Cpd-J | 5 mg |
| High Boiling Point Organic Solvent Oil-2 | 0.1 g |
| Additive P-1 | 0.1 g |
| Fifth Layer: Middle-sensitivity Red-sensitive Emulsion Layer | |
| Emulsion B | 0.2 g as Ag |
| Emulsion C | 0.3 g as Ag |
| Gelatin | 0.8 g |
| Coupler C-1 | 0.05 g |
| Coupler C-2 | 0.15 g |
| Coupler C-3 | 0.2 g |
| High Boiling Point Organic Solvent Oil-2 | 0.1 g |
| Additive P-1 | 0.1 g |
| Sixth Layer: High-sensitivity Red-sensitive Emulsion Layer | |
| Emulsion D | 0.4 g as Ag |
| Gelatin | 1.1 g |
| Coupler C-1 | 0.05 g |
| Coupler C-2 | 0.15 g |
| Coupler C-3 | 0.1 g |
| Coupler C-9 | 0.05 g |
| Additive P-1 | 0.1 g |
| Seventh Layer: Interlayer | |
| Gelatin | 0.6 g |
| Additive M-1 | 0.3 g |
| Color Mixing Preventing Agent Cpd-I | 0.03 g |
| Dye D-5 | 0.02 g |
| Compound Cpd-J | 5 mg |
| High Boiling Point Organic Solvent Oil-1 | 0.02 g |
| Eighth Layer: Interlayer | |
| Emulsion of Silver Iodobromide Grains fogged in both the surface and the inside (mean grain size: 0.06 μm, fluctuation coefficient: 16%, AgI content: 3 mol %) | 0.02 g as Ag |
| Gelatin | 1.0 g |
| Additive P-1 | 0.2 g |
| Color Mixing Preventing Agent Cpd-A | 0.1 g |
| Compound Cpd-C | 0.1 g |
| Ninth Layer: Low-sensitivity Green-sensitive Emulsion Layer | |
| Emulsion E | 0.5 g as Ag |
| Emulsion F | 0.4 g as Ag |
| Gelatin | 0.5 g |
| Coupler C-4 | 0.05 g |
| Coupler C-11 | 0.15 g |
| Coupler C-7 | 0.15 g |
| Coupler C-8 | 0.05 g |
| Compound Cpd-B | 0.03 g |
| Compound Cpd-D | 0.02 g |
| Compound Cpd-E | 0.02 g |
| Compound Cpd-F | 0.04 g |
| Compound Cpd-J | 10 mg |
| Compound Cpd-L | 0.02 g |
| High Boiling Point Organic Solvent Oil-1 | 0.15 g |
| High Boiling Point Organic Solvent Oil-2 | 0.15 g |
| Tenth Layer: Middle-sensitivity Green-sensitive Emulsion Layer | |
| Emulsion G | 0.3 g as Ag |
| Emulsion H | 0.2 g as Ag |
| Gelatin | 0.6 g |
| Coupler C-4 | 0.05 g |
| Coupler C-11 | 0.15 g |
| Coupler C-7 | 0.15 g |
| Coupler C-8 | 0.05 g |
| Compound Cpd-B | 0.03 g |
| Compound Cpd-D | 0.02 g |
| Compound Cpd-E | 0.02 g |
| Compound Cpd-F | 0.05 g |

-continued

| | |
|---|---|
| Compound Cpd-L | 0.05 g |
| High Boiling Point Organic Solvent Oil-1 | 0.15 g |
| High Boiling Point Organic Solvent Oil-2 | 0.15 g |
| Eleventh Layer: High-sensitivity Green-sensitive Emulsion Layer | |
| Emulsion I | 0.3 g as Ag |
| Emulsion J | 0.2 g as Ag |
| Gelatin | 1.0 g |
| Coupler C-4 | 0.05 g |
| Coupler C-11 | 0.17 g |
| Coupler C-7 | 0.17 g |
| Coupler C-8 | 0.05 g |
| Compound Cpd-B | 0.03 g |
| Compound Cpd-E | 0.02 g |
| Compound Cpd-F | 0.04 g |
| Compound Cpd-K | 5 mg |
| Compound Cpd-L | 0.02 g |
| High Boiling Point Organic Solvent Oil-1 | 0.17 g |
| High Boiling Point Organic Solvent Oil-2 | 0.17 g |
| Twelfth Layer: Interlayer | |
| Gelatin | 0.6 g |
| Compound Cpd-L | 0.05 g |
| High Boiling Point Organic Solvent Oil-1 | 0.05 g |
| Thirteenth Layer: Yellow Filter Layer | |
| Yellow Colloidal Silver | 0.07 g as Ag |
| Gelatin | 1.1 g |
| Color Mixing Preventing Agent Cpd-A | 0.01 g |
| Compound Cpd-L | 0.01 g |
| High Boiling Point Organic Solvent Oil-1 | 0.01 g |
| Dispersion of Fine Crystalline Solid of Dye E-2 | 0.05 g |
| Fourteenth Layer: Interlayer | |
| Gelatin | 0.6 g |
| Fifteenth Layer: Low-sensitivity Blue-sensitive Emulsion Layer | |
| Emulsion K | 0.4 g as Ag |
| Emulsion L | 0.4 g as Ag |
| Gelatin | 0.8 g |
| Coupler C-5 | 0.3 g |
| Coupler C-6 | 0.1 g |
| Coupler C-10 | 0.1 g |
| Sixteenth Layer: Middle-sensitivity Blue-sensitive Emulsion Layer | |
| Emulsion M | 0.2 g as Ag |
| Emulsion N | 0.3 g as Ag |
| Gelatin | 0.9 g |
| Coupler C-5 | 0.4 g |
| Coupler C-6 | 0.05 g |
| Coupler C-10 | 0.15 g |
| Seventeenth Layer: High-sensitivity Blue-sensitive Emulsion Layer | |
| Emulsion O | 0.4 g as Ag |
| Gelatin | 1.2 g |
| Coupler C-5 | 0.1 g |
| Coupler C-6 | 0.1 g |
| Coupler C-10 | 0.6 g |
| High Boiling Point Organic Solvent Oil-2 | 0.1 g |
| Eighteenth Layer: First Protective Layer | |
| Gelatin | 0.7 g |
| Ultraviolet Absorbent U-1 | 0.2 g |
| Ultraviolet Absorbent U-2 | 0.05 g |
| Ultraviolet Absorbent U-5 | 0.3 g |
| Formalin Scavenger Cpd-H | 0.4 g |
| Dye D-1 | 0.15 g |
| Dye D-2 | 0.05 g |
| Dye D-3 | 0.1 g |
| Nineteenth Layer: Second Protective Layer | |
| Colloidal Silver | 0.1 mg as Ag |
| Emulsion of Fine silver Iodobromide Grains (mean grain size: 0.06 μm, AgI content; 1 mol %) | 0.1 g as Ag |
| Gelatin | 0.4 g |

-continued

| Twentieth Layer: Third Protective Layer | |
|---|---|
| Gelatin | 0.4 g |
| Polymethyl Methacrylate Grains (mean grain size: 1.5 μm) | 0.1 g |
| Grains of 4/6 Copolymer of Methyl Methacrylate and Acrylic Acid (mean grain size: 1.5 μm) | 0.1 g |
| Silicone Oil | 0.03 g |
| Surfactant W-1 | 3.0 mg |
| Surfactant W-2 | 0.03 g |

All these emulsion layers contained other additives (F-1) to (F-8), in addition to the above-mentioned components. In addition, they contained a gelatin hardening agent (H-1) and, as coating and emulsifying aids, surfactants (W-3), (W-4), (W-5) and (W- 6), apart from the above-mentioned components.

Further added to the layers were phenol, 1,2 -benzisothiazolin-3-one, 2-phenoxyethanol, phenethyl alcohol and butyl p-benzoate, as antiseptic and anti-fungal agents.

Silver iodobromide emulsions used in preparing Sample No. 201 are mentioned below.

TABLE 2

| Emulsion | Characteristics of Grains | Mean Grain Size (as mean diameter of corresponding spheres) | Fluctuation Coefficient (%) | AgI Content (%) |
|---|---|---|---|---|
| A | Monodisperse tetradecahedral grains | 0.15 | 16 | 3.7 |
| B | Monodisperse cubic grains | 0.30 | 10 | 3.3 |
| C | Monodisperse tabular grains (mean aspect ratio: 2.5) | 0.50 | 18 | 5.0 |
| D | Polydisperse tabular grains (mean aspect ratio: 8.0) | 1.00 | 25 | 2.0 |
| E | Monodisperse cubic grains | 0.15 | 17 | 4.0 |
| F | Monodisperse cubic grains | 0.25 | 16 | 4.0 |
| G | Monodisperse, internal latent image-type cubic grains | 0.35 | 11 | 3.5 |
| H | Monodisperse, internal latent image-type cubic grains | 0.50 | 9 | 3.5 |
| I | Monodisperse tabular grains (mean aspect ratio: 3.0) | 0.80 | 16 | 2.5 |
| J | Polydisperse tabular grains (mean aspect ratio: 9.0) | 1.30 | 28 | 1.5 |
| K | Monodisperse tetradecahedral grains | 0.30 | 18 | 4.0 |
| L | Monodisperse spherical grains | 0.45 | 17 | 4.0 |
| M | Monodisperse tabular grains (mean aspect ratio: 4.0) | 0.65 | 14 | 3.5 |
| N | Monodisperse tabular grains (mean aspect ratio: 10.0) | 1.10 | 13 | 2.5 |
| O | Polydisperse, iodo-rich core-having twin-plane grains | 1.90 | 33 | 2.0 |

Emulsions A to J were color-sensitized by the sensitizing dye(s) mentioned in Table 3 below.

TABLE 3

| Emulsion | Sensitizing Dye(s) Added | Amount of Sensitizing Dye Added (g/mol of silver halide) |
|---|---|---|
| A | S-1 | 0.35 |
| B | S-1 | 0.2 |
| C | S-1 | 0.15 |
| D | S-1 | 0.1 |
| E | S-2 | 0.5 |
| | S-4 | 0.1 |

TABLE 3-continued

| Emulsion | Sensitizing Dye(s) Added | Amount of Sensitizing Dye Added (g/mol of silver halide) |
|---|---|---|
| F | S-2 | 0.3 |
| | S-4 | 0.06 |
| G | S-2 | 0.25 |
| | S-4 | 0.04 |
| H | S-3 | 0.2 |
| | S-4 | 0.06 |
| I | S-3 | 0.15 |
| | S-4 | 0.05 |
| | S-5 | 0.07 |
| J | S-3 | 0.10 |
| | S-4 | 0.03 |
| | S-5 | 0.04 |

Emulsions K to O were color-sensitized by the sensitizing dye(s) mentioned in Table 4 below.

TABLE 4

| Emulsion | Sensitizing Dye(s) Added | Amount of Sensitizing Dye Added (g/mol of silver halide) |
|---|---|---|
| K | S-6 | 0.15 |
| L | S-6 | 0.12 |
| M | S-6 | 0.15 |
| N | S-6 | 0.12 |
| O | S-6 | 0.10 |
| | S-7 | 0.03 |

Compounds used in preparing Sample No. 201 are mentioned below.

C-1
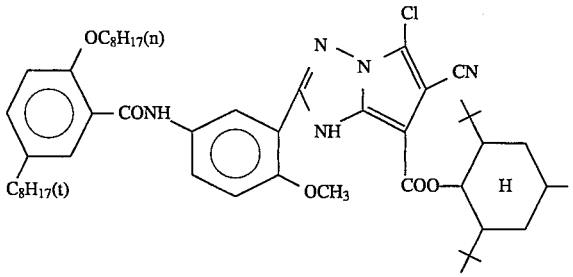
C-2
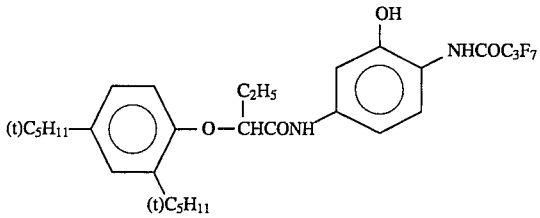
C-3
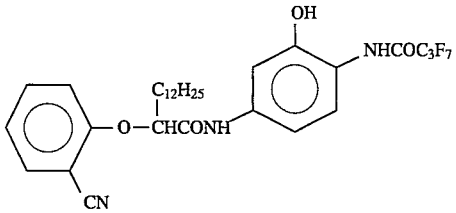
C-4
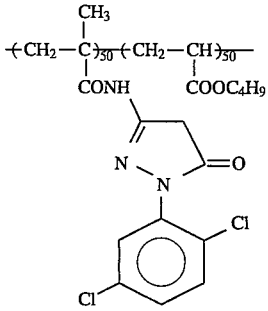
(wt. %, mean molecular weight: Ca. 25,000)
C-5
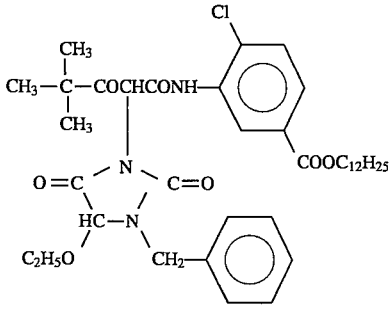
C-6
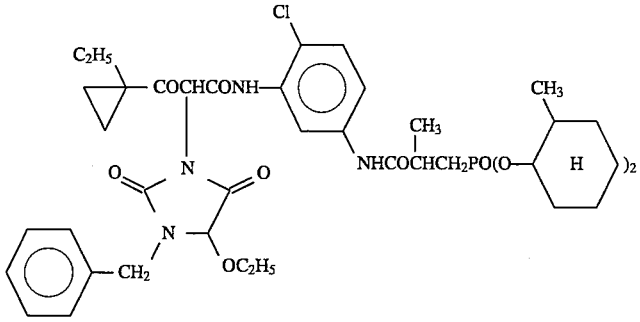

-continued
C-7
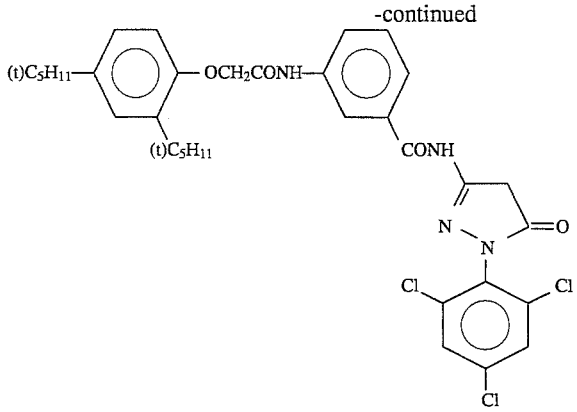
C-8
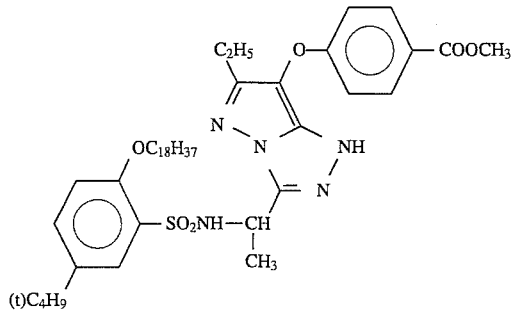
C-9
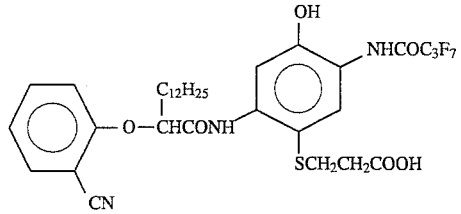
C-10
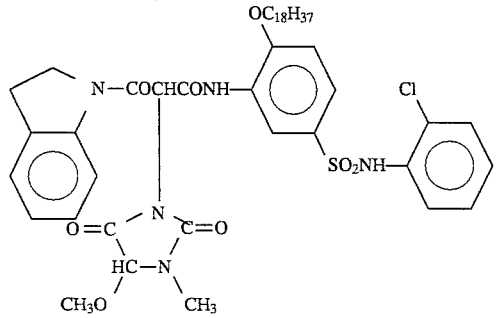
C-11
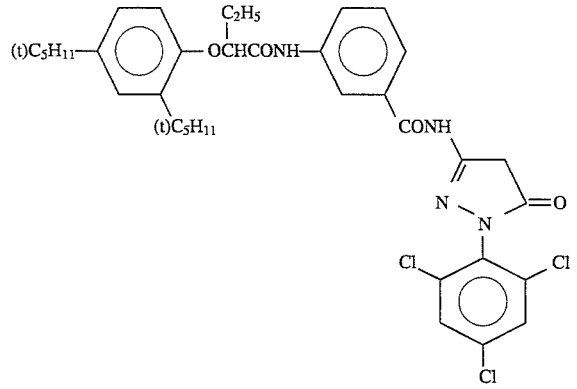
Dibutyl Phthalate — Oil-1
Tricrexyl Phosphate — Oil-2

-continued
Oil-3
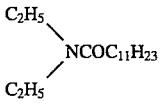
Cpd-A
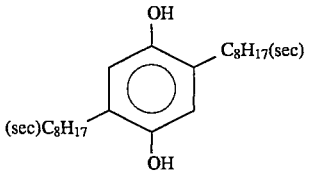
Cpd-B
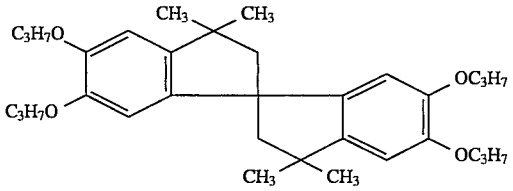
Cpd-C
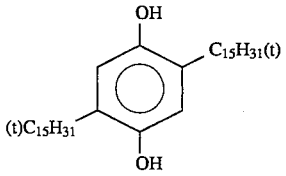
Cpd-D
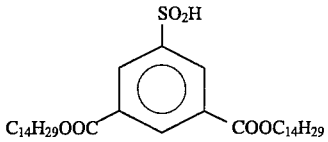
Cpd-E
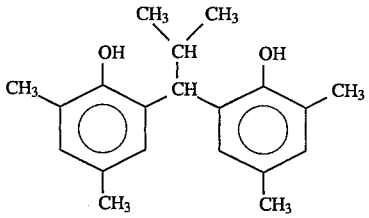
Cpd-F
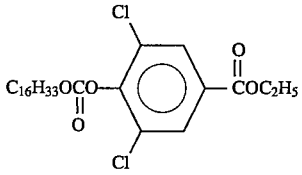
Cpd-H
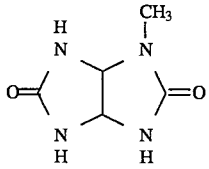
Cpd-I
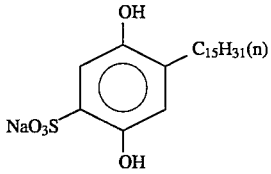

-continued
Cpd-J
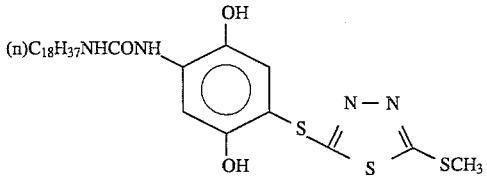
Cpd-K
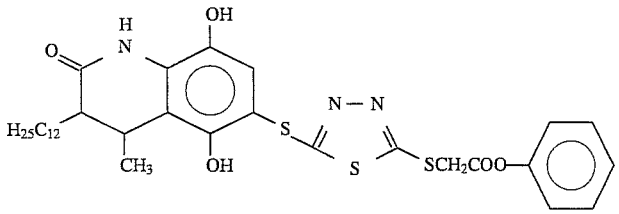
Cpd-L
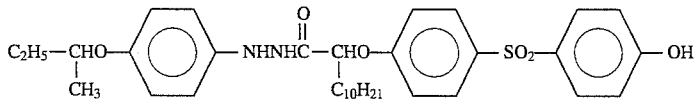
U-1
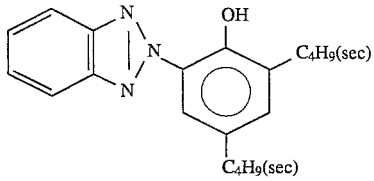
U-2
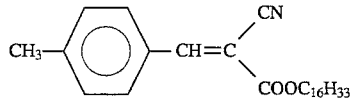
U-3
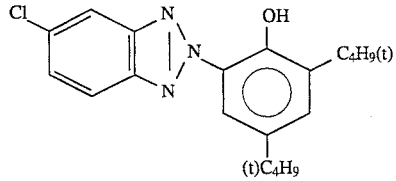
U-4
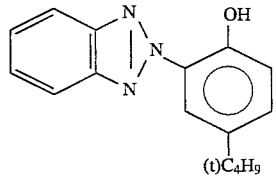
U-5
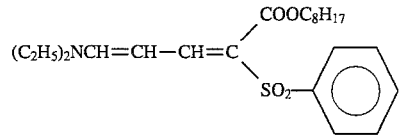
S-1
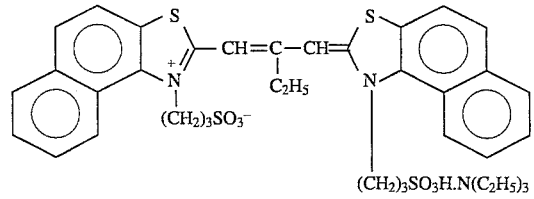
S-2
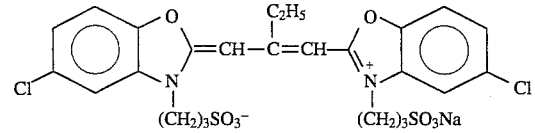

-continued
S-3
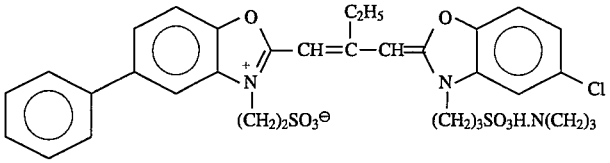
S-4
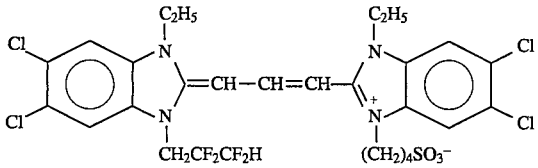
S-5
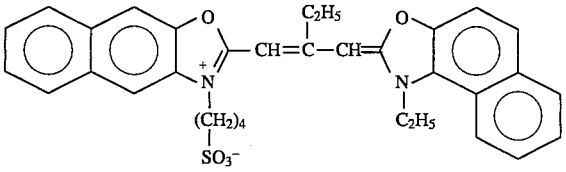
S-6
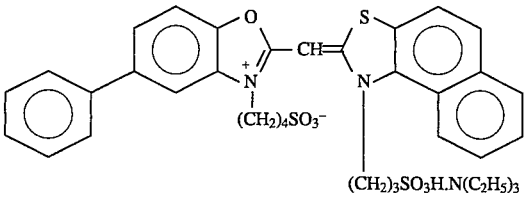
S-7
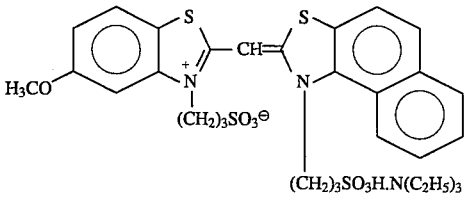
D-1
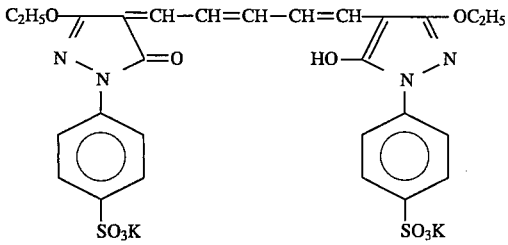
D-2
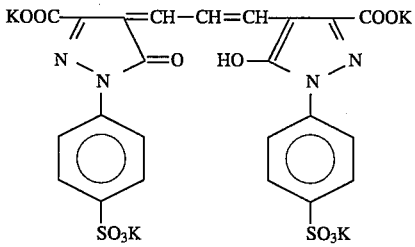
D-3
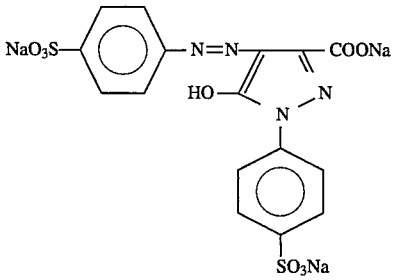

-continued
D-4
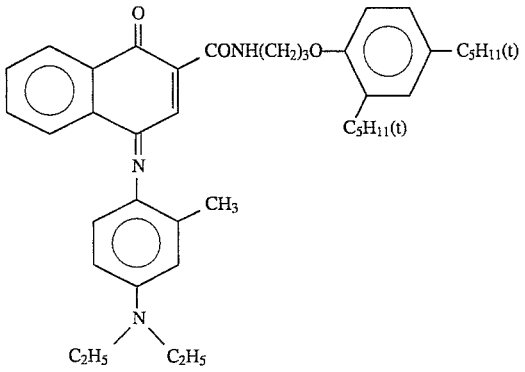
D-5
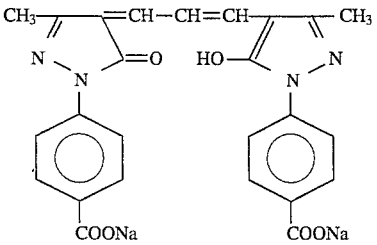
E-1
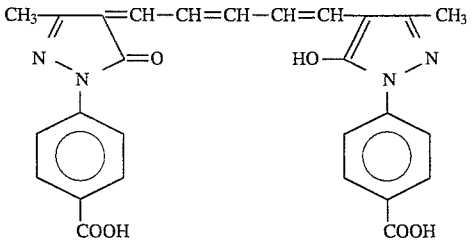
E-2
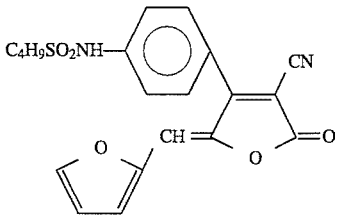
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
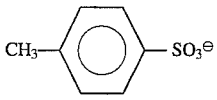
W-2
$C_8F_{17}SO_2N(C_3H_7)CH_2COOK$
W-3
$NaO_3S{-}CH(CH_2COOCH_2CH(C_2H_5)C_4H_9){-}COOCH_2CH(C_2H_5)C_4H_9$
W-4
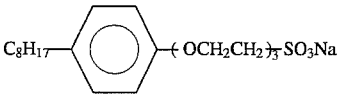

-continued
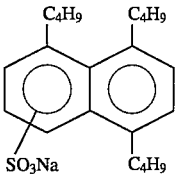
W-5
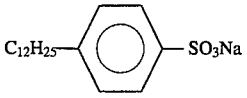
W-6
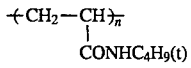
(n = 100–1000)
P-1
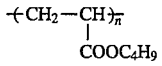
(n = 100–1000)
M-1
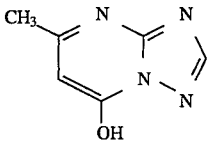
F-1
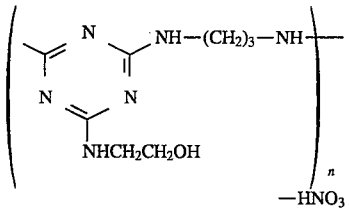
(n = 2–10)
F-2
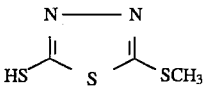
F-3
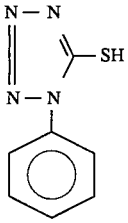
F-4
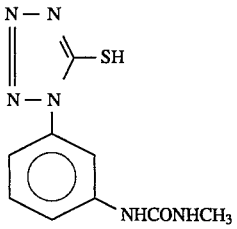
F-5
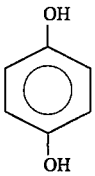
F-6

-continued

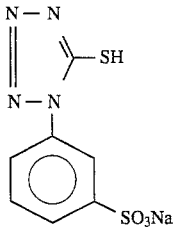

F-7

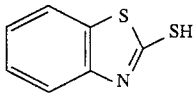

F-8

Sample Nos. 202 to 209 were prepared in the same manner as in preparation of Sample No. 201, except that high boiling point organic solvents Oil-1 and Oil-2 in 9th, 10th and 11th layers were uniformly reduced and replaced by a determined amount of the compound of the present invention or the comparative compound indicated in Table 5 below.

Comparative compounds (Cf-59) and (cf-61) used in Table 5 are mentioned below.

TABLE 5

| Sample No. | | High Boiling Point Organic Solvent in 9th, 10th and 11th layers: Compound | Substituted Amount (%) |
|---|---|---|---|
| 201 | comparative sample | (not substituted) | 0 |
| 202 | sample of the invention | S-8 | 1 |
| 203 | sample of the invention | S-8 | 5 |
| 204 | sample of the invention | S-8 | 10 |
| 205 | sample of the invention | S-8 | 40 |
| 206 | sample of the invention | S-8 | 100 |
| 207 | sample of the invention | S-7 | 10 |
| 208 | comparative sample | cf-59 | 10 |
| 209 | comparative sample | cf-61 | 10 |

cf-59 $(C_{10}H_{21}-O)_2P(=O)-OH$ cf-61 $(CH_2=CH-CH_2-O)_2P(=O)-OH$

Sample Nos. 201 to 209 thus prepared were wedgewise exposed, using a halogen lamp having a color temperature of 3200° K. as a light source, through an optical wedge and then developed according to the process mentioned below. Using a Status A4 Filter, the densities of the three colors of R, G and G of the images thus obtained were measured, from which the characteristic curves of R, G and B were obtained. Each sample was formed into a sheet film having a size of 4 inches×5 inches, which was then subjected to uniform gray exposure and developed in the same manner as mentioned above. The degree of uneven development, if any, of each sample was checked.

The process used for the development and the processing solutions used in the process are mentioned below.

Process for Development:

| Step | Time (min) | Temp. (°C.) | Tank Capacity (liters) | Amount of Replenisher (ml/m²) |
|---|---|---|---|---|
| First Development | 6 | 38 | 12 | 2200 |
| First Washing | 2 | 38 | 4 | 7500 |
| Reversal | 2 | 38 | 4 | 1100 |
| Color Development | 6 | 38 | 12 | 2200 |
| Pre-bleaching | 2 | 38 | 4 | 1100 |
| Bleaching | 6 | 38 | 12 | 220 |
| Fixation | 4 | 38 | 8 | 1100 |
| Second Washing | 4 | 38 | 8 | 7500 |
| Final Rinsing | 1 | 38 | 2 | 1100 |

Compositions of the processing solutions used in the above-mentioned process are mentioned below.

| Components | Tank Solution | Replenisher |
|---|---|---|
| **First Developer** | | |
| Pentasodium Nitrilo-N,N,N-trimethylenephosphonate | 1.5 g | 1.5 g |
| Pentasodium Diethylenetriamine-pentaacetate | 2.0 g | 2.0 g |
| Sodium Sulfite | 30 g | 30 g |
| Potassium Hydroquinone-monosulfonate | 20 g | 20 g |
| Potassium Carbonate | 15 g | 20 g |
| Sodium Bicarbonate | 12 g | 15 g |
| 1-Phenyl-4-methyl-4-hydroxymethyl-3-pyrazolidone | 1.5 g | 2.0 g |
| Potassium Bromide | 2.5 g | 1.4 g |
| Potassium Thiocyanate | 1.2 g | 1.2 g |
| Potassium Iodide | 2.0 mg | — |
| Diethylene Glycol | 13 g | 15 g |
| Water to make | 1000 ml | 1000 ml |
| pH (adjusted with sulfuric acid or potassium hydroxide) | 9.60 | 9.60 |
| **Reversal Solution** | | |
| Pentasodium Nitrile-N,N,N-trimethylenephosphonate | 3.0 g | 3.0 g |
| Stannous Chloride Di-hydrate | 1.0 g | 1.0 g |
| P-aminophenol | 0.1 g | 0.1 g |
| Sodium Hydroxide | 8 g | 8 g |
| Glacial Acetic Acid | 15 ml | 15 ml |
| Water to make | 1000 ml | 1000 ml |
| pH (adjusted with acetic acid or sodium hydroxide) | 6.00 | 6.00 |

-continued

| Color Developer | | |
|---|---|---|
| Pentasodium Nitrilo-N,N,N-trimethylenephosphonate | 2.0 g | 2.0 g |
| Sodium Sulfite | 7.0 g | 7.0 g |
| Trisodium Phosphate 12-Hydrate | 36 g | 36 g |
| Potassium Bromide | 1.0 g | — |
| Potassium Iodide | 90 mg | — |
| Sodium Hydroxide | 3.0 g | 3.0 g |
| Citrazinic Acid | 1.5 g | 1.5 g |
| N-ethyl-N-(β-methanesulfonamidoethyl)-3-methyl-4-aminoaniline 3/2 Sulfate Mono-hydrate | 11 g | 11 g |
| 3,6-Dithiaoctane-1,8-diol | 1.0 g | 1.0 g |
| Water to make | 1000 ml | 1000 ml |
| pH (adjusted with hydrochloric acid or sodium hydroxide) | 11.8 | 12.00 |

| Components | Tank Solution, Replenisher |
|---|---|
| **Fixing Solution** | |
| Ammonium Thiosulfate | 80 g |
| Sodium Sulfite | 5.0 g |
| Sodium Bisulfite | 5.0 g |
| Water to make | 1000 ml |
| pH (adjusted with hydrochloric acid or aqueous ammonia) | 6.60 |
| **Stabilizing Solution** | |
| Formalin (37%) | 5.0 ml |
| Polyoxyethylene-p-monononylphenyl Ether (mean polymerization degree: 10) | 0.5 ml |
| Water to make | 1000 ml |

As the developing machine, used was H4R-240 Model (hanger-type developing machine having a hanger with claws; made by Noritsu Kohki KK).

The test results obtained are shown in Table 6 below. The uneven development in the processed samples was caused by the liquid drops from the hanger with claws generally used in the hanger-type developing machine, giving uneven colors in the gray-colored area of the processed sample In Table 6, "O" means that there appeared no uneven color; "Δ" means that only slight uneven colors appeared; "x" means that visible uneven colors appeared; "xx" means that strong uneven colors appeared; and "xxx" means that greatly strong uneven colors appeared. Since the uneven development lowers the quality of the image formed, it is desired that such uneven colors are minimized as much as possible in processed photographic materials.

The developed samples were post-bleached, using a magenta-selective bleaching solution (SR-32; made by Eastman Kodak Co.) prepared according to the maker's general formulation. Precisely, the processed samples were dipped in the bleaching solution at room temperature, whereupon the time (sec.) needed to bleach 10% of the magenta density of 2.0 in the original image in each sample was measured. The thus-measured time was referred to as the bleaching rate. The shorter the bleaching rate, the better the processability. However, if the rate is too short, the density cannot be controlled strictly. In practical use, therefore, the rate is preferably about 100 seconds.

As is noted from Table 6 below, the compounds represented by the formula (1) of the present invention were effective in reducing uneven development. However, the uneven development in Sample Nos. 208 and 209 containing (cf-59) (having linear alkyl groups with 20 carbon atoms in total) and (cf-61) (this has unsaturated straight-chain aliphatic groups, but the sum of the carbon atoms in the groups is 6), respectively, was not reduced. [(cf-59) and (cf-61) are known compounds described in EP-A- 553964.] The compounds represented by the formula (1) of the present invention were also noticeably effective in shortening the bleaching rate when SR-32 was used for post-bleaching. However, the effect of the comparative compounds was only small. The compounds represented by the formula (1) of the present invention were found significantly effective, when used in an amount of approximately from 5% to 50% relative to the total amount of the high boiling point organic solvents used.

TABLE 6

| Sample No. | | Degree of Uneven Development | Bleaching Rate in Post-bleaching with SR-32 (Sec.) |
|---|---|---|---|
| 201 | comparative sample | X (uneven red and green colors) | 360 |
| 202 | sample of the invention | Δ(uneven red and green colors) | 320 |
| 203 | sample of the invention | Δ(uneven red and green colors) | 130 |
| 204 | sample of the invention | O | 110 |
| 205 | sample of the invention | O | 90 |
| 206 | sample of the invention | Δ(uneven red and green colors) | 80 |
| 207 | sample of the invention | O | 100 |
| 208 | comparative sample | X(uneven red and green colors) | 330 |
| 209 | comparative sample | X(uneven red and green colors) | 350 |

EXAMPLE 3

Sample Nos. 201 to 209 prepared in Example 2 were processed by the same process as that employed in Example 2, except that the color developer was replaced by that having the composition mentioned below, and the processed samples were tested in the same manner as in Example 2.

| Components | Tank Solution | Replenisher |
|---|---|---|
| **Color Developer** | | |
| Pentasodium Nitrilo-N,N,N-trimethylenephosphonate | 0.5 g | 0.5 g |
| 3,6-Dithiaoctane-1,8-diol | 0.25 g | 0.25 g |
| Sodium Sulfite | 2.5 g | 3.0 g |
| Pentasodium Diethylenetriamine-pentaacetate | 2.0 g | 2.0 g |
| Potassium Bromide | 0.5 g | — |
| Potassium Iodide | 30 mg | — |
| Hydroxylamine Sulfate | 1.5 g | 1.8 g |
| N-ethyl-N-(β-methanesulfonamidoethyl)-3-methyl-4-aminoaniline 3/2 Sulfate Monohydrate | 11.0 g | 11.0 g |
| Water to make | 1000 ml | 1000 ml |
| pH (adjusted with sodium hydroxide) | 10.6 | 10.8 |

Precisely, the processed samples were checked with respect to the condition of uneven development, if any, according to the same manner as in Example 2. No uneven colors were found in Sample Nos. 201 to 209. Accordingly, it is noted that the compounds represented by the formula (1)

of the present invention are more effective when the photographic materials are processed with a developer such as that used in Example 2 and having a pH of not lower than 10.8 and a bromide content of not lower than 0.005 mol/liter (potassium bromide content of 0.6 g/liter or more).

EXAMPLE 4

Sample Nos. 201 to 209 prepared in Example 2 were processed by the same process as that employed in Example 2, except that the first developer was replaced by that having the composition mentioned below, and the processed samples were tested in the same manner as in Example 2. The results obtained are shown in Table 7 below.

| Components | Mother Solution | Replenisher |
|---|---|---|
| First Developer | | |
| Pentasodium Nitrilo-N,N,N-trimethylenephosphonate | 3.0 g | 3.0 g |
| Pentasodium Diethylenetriamine-pentaacetate | 3.0 g | 3.0 g |
| Potassium Sulfite | 30.0 g | 30.0 g |
| Potassium Hydroquinone-monosulfonate | 27.0 g | 33.0 g |
| Potassium Carbonate | 33.0 g | 33.0 g |
| 1-Phenyl-4-methyl-4-hydroxymethyl-3-pyrazolidone | 1.7 g | 2.0 g |
| Potassium Bromide | 5.2 g | — |
| Potassium Thiocyanate | 1.2 g | 1.3 g |
| Potassium Iodide | 0.015 g | — |
| Water to make | 1000 ml | 1000 ml |
| pH at 25° C. (adjusted with KOH/sulfuric acid) | 9.70 | 9.85 |

Using the above-mentioned mother solution and replenisher, each sample was processed continuously, while replenishing 500 ml/m$^2$ of the replenisher to the black-and-white developing tank, until the total amount of the replenisher added became three times the capacity of the tank. After the running process, the potassium bromide concentration in the tank was 5.5 g/liter, the potassium iodide concentration in the same was 0.014 g/liter, and the pH of the fatigued solution was 9.80.

TABLE 7

| Sample No. | | Degree of Uneven Development | Increase in Stains in Processed Samples (after stored at 58° C. and 80% RH for one day) |
|---|---|---|---|
| 201 | comparative sample | XXX | 0.02 |
| 202 | sample of the invention | XX | 0.01 |
| 203 | sample of the invention | Δ | 0.01 |
| 204 | sample of the invention | ○ | 0.00 |
| 205 | sample of the invention | ○ | 0.00 |
| 206 | sample of the invention | X | 0.00 |
| 207 | sample of the invention | ○ | 0.00 |
| 208 | comparative sample | XX | 0.02 |
| 209 | comparative sample | XX | 0.02 |

The amount of the replenisher to the first developer in Example 4 was 500 ml/m$^2$ or is about ⅕ of 2200 ml/m$^2$ in Example 2. Such noticeable reduction in the amount of the replenisher is favorable, as resulting in the reduction in the amount of the waste liquid from the step. However, as is noted from Table 7 above, such reduction caused noticeable uneven development and great increase in the stains of the processed samples with the lapse of time. Because of these problems, reduction in the amount of the replenisher was not practically applicable to conventional photographic materials (see Sample No. 201 in Table 7). Using the compounds represented by the formula (1) of the present invention, however, such uneven development and increase in stains may be noticeably reduced.

EXAMPLE 5

Preparation of Sample No. 501

Plural layers each having the composition mentioned below were coated on a subbing layer-coated cellulose triacetate film support (thickness: 127 μm) to prepare a multi-layered color photographic material sample, which was referred to as Sample No. 501. In the following compositions, the amount of each component coated is per m$^2$. The effect of the compound added is not limited to the use described.

| | |
|---|---|
| First Layer: Anti-halation Layer | |
| Black Colloidal Silver | 0.20 g as Ag |
| Gelatin | 1.9 g |
| Ultraviolet Absorbent U-1 | 0.1 g |
| Ultraviolet Absorbent U-3 | 0.04 g |
| Ultraviolet Absorbent U-4 | 0.1 g |
| High Boiling Point Organic Solvent Oil-1 | 0.1 g |
| Second Layer: Interlayer | |
| Gelatin | 0.40 g |
| Compound Cpd-C | 5 mg |
| Compound Cpd-J | 5 mg |
| Compound Cpd-K | 3 mg |
| High Boiling Point Organic Solvent Oil-3 | 0.1 g |
| Dye D-1 | 0.8 mg |
| Third Layer: Interlayer | |
| Emulsion of Fine Silver Iodobromide Grains fogged in both the surface and the inside (mean grain size: 0.06 μm, fluctuation coefficient: 18%, AgI content: 1 mol %) | 0.05 g as Ag |
| Gelatin | 0.4 g |
| Fourth Layer: Low-sensitivity Red-sensitive Emulsion Layer | |
| Emulsion A | 0.3 g as Ag |
| Emulsion B | 0.2 g as Ag |
| Gelatin | 0.8 g |
| Coupler C-1 | 0.15 g |
| Coupler C-2 | 0.05 g |
| Coupler C-3 | 0.05 g |
| Coupler C-9 | 0.05 g |
| Compound Cpd-C | 5 mg |
| Compound Cpd-J | 5 mg |
| High Boiling Point Organic Solvent Oil-2 | 0.1 g |
| Additive P-1 | 0.1 g |
| Fifth Layer: Middle-sensitivity Red-sensitive Emulsion Layer | |
| Emulsion B | 0.2 g as Ag |
| Emulsion C | 0.3 g as Ag |
| Gelatin | 0.8 g |
| Coupler C-1 | 0.2 g |
| Coupler C-2 | 0.05 g |
| Coupler C-3 | 0.2 g |
| High Boiling Point Organic Solvent Oil-2 | 0.1 g |

-continued

| | |
|---|---|
| Additive P-1 | 0.1 g |
| Sixth Layer: High-sensitivity Red-sensitive Emulsion Layer | |
| Emulsion D | 0.4 g as Ag |
| Gelatin | 1.1 g |
| Coupler C-1 | 0.3 g |
| Coupler C-2 | 0.1 g |
| Coupler C-3 | 0.7 g |
| Additive P-1 | 0.1 g |
| Seventh Layer: Interlayer | |
| Gelatin | 0.6 g |
| Additive M-1 | 0.3 g |
| Color Mixing Preventing Agent Cpd-I | 2.6 mg |
| Dye D-2 | 0.05 g |
| Compound Cpd-J | 5 mg |
| High Boiling Point Organic Solvent Oil-1 | 0.02 g |
| Eighth Layer: Interlayer | |
| Emulsion of Silver Iodobromide Grains fogged in both the surface and the inside (mean grain size: 0.06 μm, fluctuation coefficient: 16%, AgI content: 0.3 mol %) | 0.02 g as Ag |
| Gelatin | 1.0 g |
| Additive P-1 | 0.2 g |
| Color Mixing Preventing Agent Cpd-A | 0.1 g |
| Compound Cpd-C | 0.1 g |
| Ninth Layer: Low-sensitivity Green-sensitive Emulsion Layer | |
| Emulsion E | 0.1 g as Ag |
| Emulsion F | 0.2 g as Ag |
| Emulsion G | 0.2 g as Ag |
| Gelatin | 0.5 g |
| Coupler C-4 | 0.1 g |
| Coupler C-7 | 0.05 g |
| Coupler C-8 | 0.20 g |
| Compound Cpd-B | 0.03 g |
| Compound Cpd-D | 0.02 g |
| Compound Cpd-E | 0.02 g |
| Compound Cpd-F | 0.04 g |
| Compound Cpd-J | 10 mg |
| Compound Cpd-L | 0.02 g |
| High Boiling Point Organic Solvent Oil-2 | 0.28 g |
| Tenth Layer: Middle-sensitivity Green-sensitive Emulsion Layer | |
| Emulsion G | 0.3 g as Ag |
| Emulsion H | 0.1 g as Ag |
| Gelatin | 0.6 g |
| Coupler C-4 | 0.1 g |
| Coupler C-7 | 0.2 g |
| Coupler C-8 | 0.1 g |
| Compound Cpd-B | 0.03 g |
| Compound Cpd-D | 0.02 g |
| Compound Cpd-E | 0.02 g |
| Compound Cpd-F | 0.05 g |
| Compound Cpd-L | 0.05 g |
| High Boiling Point Organic Solvent Oil-2 | 0.32 g |
| Eleventh Layer: High-sensitivity Green-sensitive Emulsion Layer | |
| Emulsion I | 0.5 g as Ag |
| Gelatin | 1.0 g |
| Coupler C-4 | 0.3 g |
| Coupler C-7 | 0.1 g |
| Coupler C-8 | 0.1 g |
| Compound Cpd-B | 0.08 g |
| Compound Cpd-E | 0.02 g |
| Compound Cpd-F | 0.04 g |
| Compound Cpd-K | 5 mg |
| Compound Cpd-L | 0.02 g |
| High Boiling Point Organic Solvent Oil-2 | 0.4 g |
| Twelfth Layer: Interlayer | |
| Gelatin | 0.6 g |
| Compound Cpd-L | 0.05 g |

-continued

| | |
|---|---|
| High Boiling Point Organic Solvent Oil-1 | 0.05 g |
| Thirteenth Layer: Yellow Filter Layer | |
| Yellow Colloidal Silver | 0.07 g as Ag |
| Gelatin | 1.1 g |
| Color Mixing Preventing Agent Cpd-A | 0.01 g |
| Compound Cpd-L | 0.01 g |
| High Boiling Point Organic Solvent Oil-1 | 0.01 g |
| Fourteenth Layer: Interlayer | |
| Gelatin | 0.6 g |
| Fifteenth Layer: Low-sensitivity Blue-sensitive Emulsion Layer | |
| Emulsion J | 0.2 g as Ag |
| Emulsion K | 0.3 g as Ag |
| Gelatin | 0.8 g |
| Coupler C-5 | 0.2 g |
| Coupler C-6 | 0.1 g |
| Coupler C-10 | 0.4 g |
| Sixteenth Layer: Middle-sensitivity Blue-sensitive Emulsion Layer | |
| Emulsion L | 0.5 g as Ag |
| Gelatin | 0.9 g |
| Coupler C-5 | 0.1 g |
| Coupler C-6 | 0.1 g |
| Coupler C-10 | 0.6 g |
| Seventeenth Layer: High-sensitivity Blue-sensitive Emulsion Layer | |
| Emulsion M | 0.2 g as Ag |
| Emulsion N | 0.2 g as Ag |
| Gelatin | 1.2 g |
| Coupler C-5 | 0.1 g |
| Coupler C-6 | 0.1 g |
| Coupler C-10 | 0.6 g |
| High Boiling Point Organic Solvent Oil-2 | 0.1 g |
| Eighteenth Layer: First Protective Layer | |
| Gelatin | 0.7 g |
| Ultraviolet Absorbent U-1 | 0.2 g |
| Ultraviolet Absorbent U-2 | 0.05 g |
| Ultraviolet Absorbent U-3 | 0.3 g |
| Formalin Scavenger Cpd-H | 0.4 g |
| Nineteenth Layer: Second Protective Layer | |
| Colloidal Silver | 0.1 mg as Ag |
| Emulsion of Fine Silver Iodobromide Grains (mean grain size: 0.06 μm, AgI content: 1 mol %) | 0.1 g as Ag |
| Gelatin | 0.4 g |
| Twentieth Layer: Third Protective Layer | |
| Gelatin | 0.4 g |
| Polymethyl Methacrylate Grains (mean grain size: 1.5 μm) | 0.1 g |
| Grains of 4/6 Copolymer of Methyl Methacrylate and Acrylic Acid (mean grain size: 1.5 μm) | 0.1 g |
| Silicone Oil | 0.03 g |
| Surfactant W-1 | 3.0 mg |
| Surfactant W-2 | 0.03 g |

All these emulsion layers contained other additives (F-1) to (F-8), in addition to the above-mentioned components. In addition, they contained a gelatin hardening agent (H-1) and, as coating and emulsifying aids, surfactants (W-3), (W-4), (W-5) and (W- 6), apart from the above-mentioned components.

Further added to the layers were phenol, 1,2 -benzisothiazolin-3-one, 2-phenoxyethanol, phenethyl alcohol and butyl p-benzoate, as antiseptic and anti-fungal agents.

Silver iodobromide emulsions used in preparing Sample No. 501 are mentioned below.

TABLE 8

| Emulsion | Characteristics of Grains | Mean Grain Size (as mean diameter of corresponding spheres) | Fluctuation Coefficient (%) | AgI Content (%) |
|---|---|---|---|---|
| A | Monodisperse tetradecahedral grains | 0.28 | 16 | 4.0 |
| B | Monodisperse cubic grains | 0.30 | 10 | 4.0 |
| C | Monodisperse cubic grains | 0.38 | 10 | 5.0 |
| D | Monodisperse tabular grains (mean aspect ratio: 3.0) | 0.68 | 15 | 2.0 |
| E | Monodisperse cubic grains | 0.20 | 17 | 4.0 |
| F | Monodisperse tetradecahedral grains | 0.23 | 16 | 4.0 |
| G | Monodisperse cubic grains | 0.28 | 11 | 4.0 |
| H | Monodisperse cubic grains | 0.32 | 9 | 3.5 |
| I | Monodisperse tabular grains (mean aspect ratio: 5.0) | 0.80 | 15 | 2.0 |
| J | Monodisperse cubic grains | 0.30 | 18 | 4.0 |
| K | Monodisperse tetradecahedral grains | 0.45 | 17 | 4.0 |
| L | Monodisperse tabular grains (mean aspect ratio: 5.0) | 0.55 | 13 | 2.0 |
| M | Monodisperse tabular grains (mean aspect ratio: 6.0) | 1.00 | 15 | 1.5 |
| N | Monodisperse tabular grains (mean aspect ratio: 9.0) | 1.20 | 17 | 1.5 |

Emulsions A to I were color-sensitized by the sensitizing dye(s) mentioned in Table 9 below.

TABLE 9

| Emulsion | Sensitizing Dye(s) Added | Amount of Sensitizing Dye Added (g/mol of silver halide) |
|---|---|---|
| A | S-2 | 0.025 |
| | S-3 | 0.25 |
| | S-7 | 0.01 |
| B | S-1 | 0.01 |
| | S-3 | 0.25 |
| | S-7 | 0.01 |
| C | S-1 | 0.01 |
| | S-2 | 0.01 |
| | S-3 | 0.25 |
| | S-7 | 0.01 |
| D | S-2 | 0.01 |
| | S-3 | 0.10 |
| | S-7 | 0.01 |
| E | S-4 | 0.6 |
| F | S-4 | 0.4 |
| G | S-4 | 0.38 |
| H | S-4 | 0.31 |
| I | S-4 | 0.47 |

Emulsions J to N were color-sensitized by the sensitizing dye(s) mentioned in Table 10 below.

TABLE 10

| Emulsion | Sensitizing Dye(s) Added | Amount of Sensitizing Dye Added (g/mol of silver halide) |
|---|---|---|
| J | S-5 | 0.05 |
| | S-6 | 0.2 |
| K | S-5 | 0.05 |
| | S-6 | 0.2 |
| L | S-5 | 0.06 |
| | S-6 | 0.22 |
| M | S-5 | 0.04 |
| | S-6 | 0.15 |
| N | S-5 | 0.06 |
| | S-6 | 0.22 |

Compounds used in preparing Sample No. 501 are mentioned below.

Coupler C-1
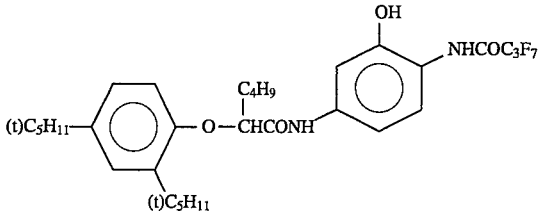
Coupler C-2
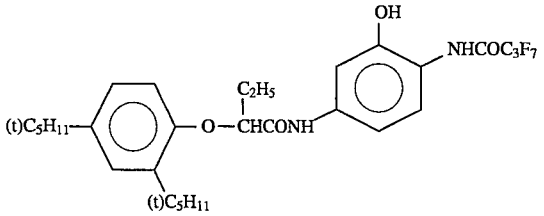
Coupler C-3
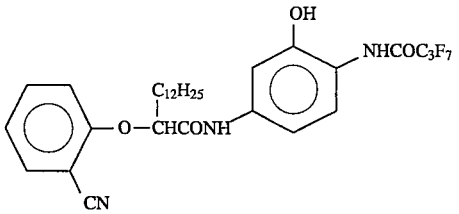
Coupler C-4
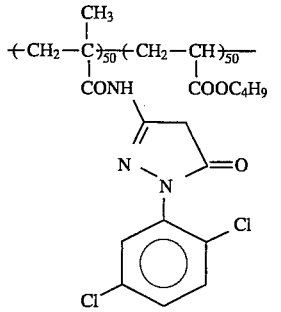
(wt. %, mean molecular weight: ca. 25,000)
Coupler C-5
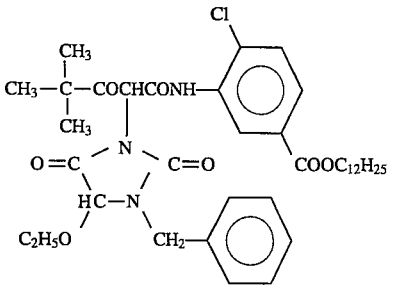
Coupler C-6
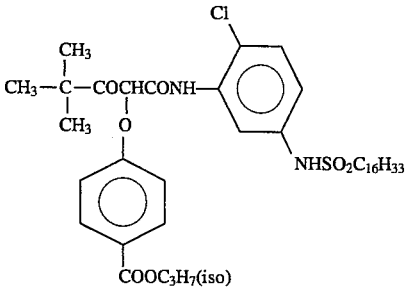

-continued
Coupler C-7
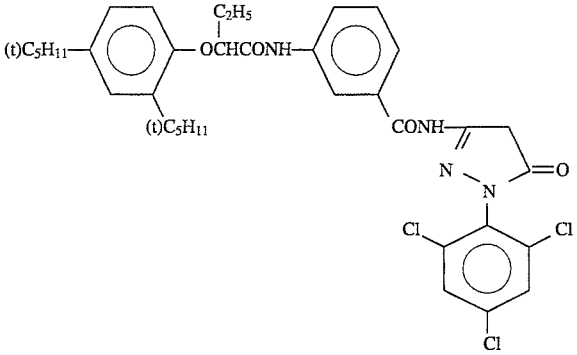
Coupler C-8
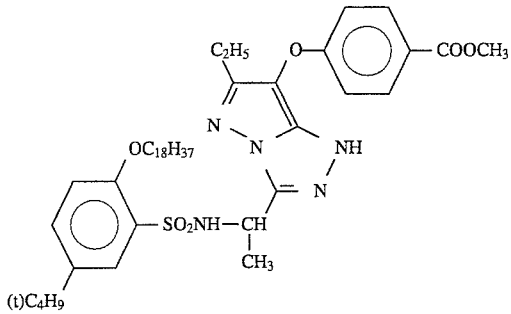
Coupler C-9
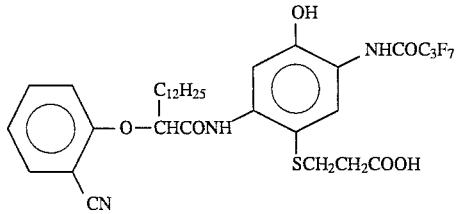
Coupler C-10
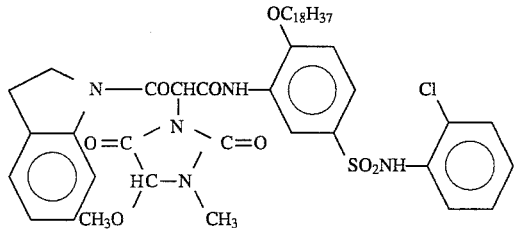
Digutyl Phthalate — Oil-1
Tricresyl Phosphate — Oil-2
Oil-3
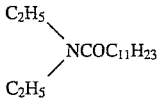
Cpd-A
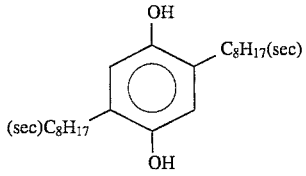
Cpd-B
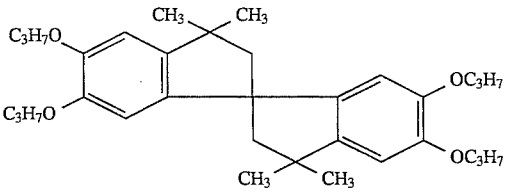

-continued
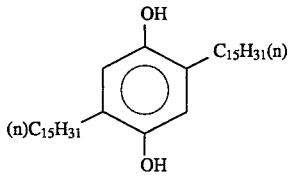
Cpd-C
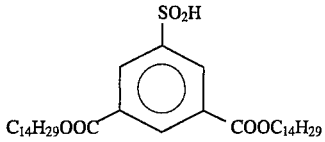
Cpd-D
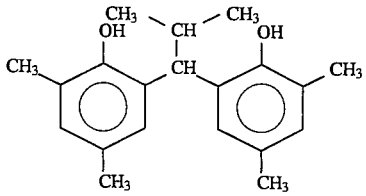
Cpd-E
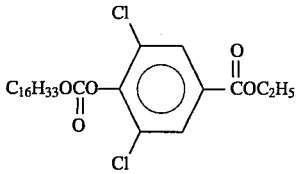
Cpd-F
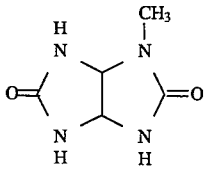
Cpd-H
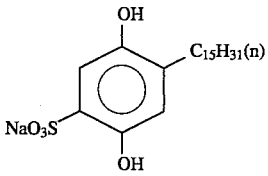
Cpd-I
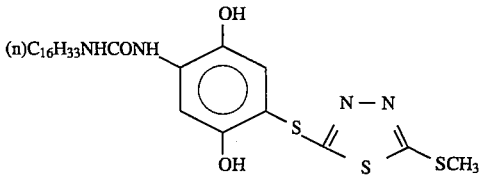
Cpd-J
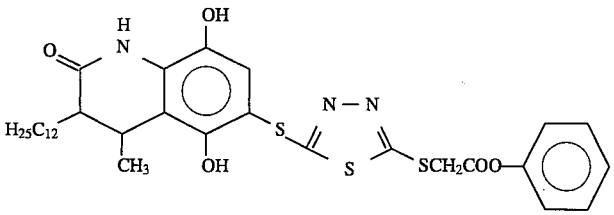
Cpd-K
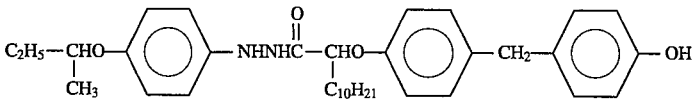
Cpd-L -continued
U-1
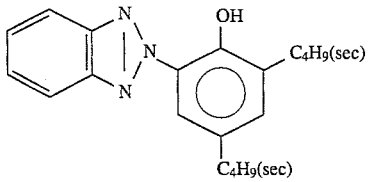
U-2
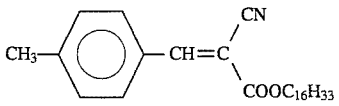
U-3
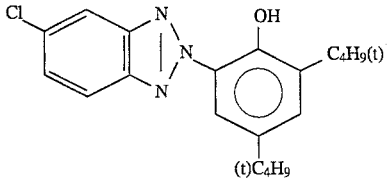
U-4
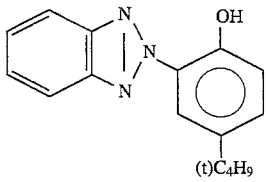
S-1
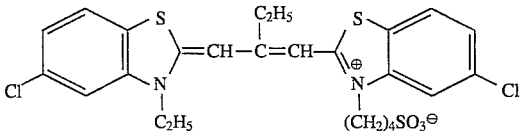
S-2
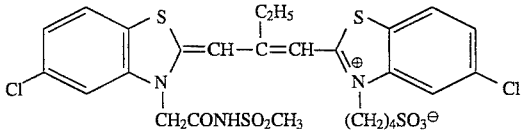
S-3
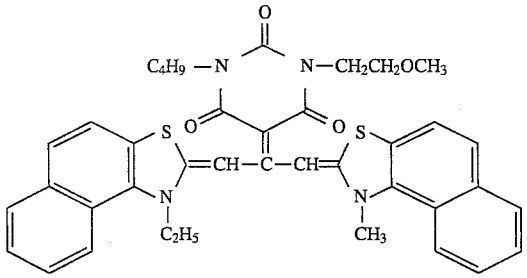
S-4
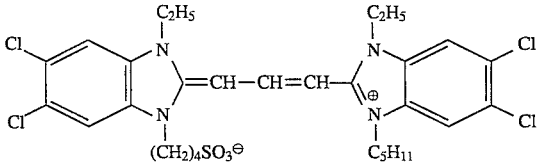
S-5
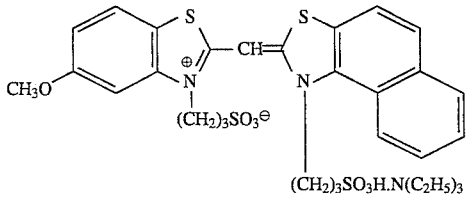

-continued
S-6
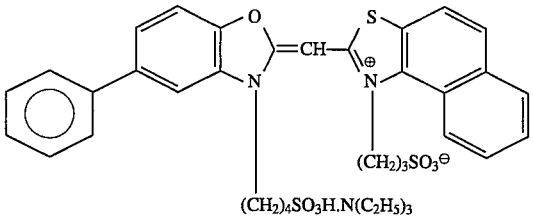
S-7
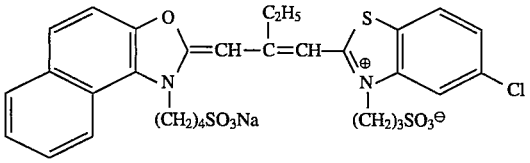
D-1
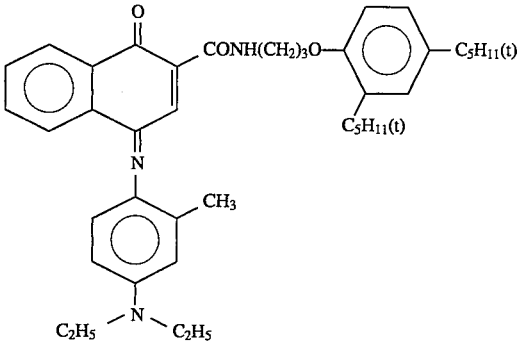
D-2
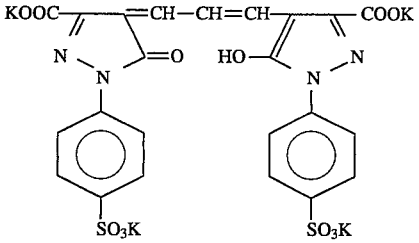
H-1
$CH_2{=}CH{-}SO_2{-}CH_2{-}CONH{-}CH_2$
$CH_2{=}CH{-}SO_2{-}CH_2{-}CONH{-}CH_2$
W-1
$C_8F_{17}SO_2NHCH_2CH_2CH_2OCH_2CH_2\overset{\oplus}{N}(CH_3)_3$
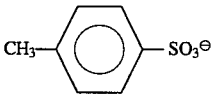
W-2
$C_8F_{17}SO_2N(C_3H_7)CH_2COOK$
W-3
$NaO_3S{-}CH(CH_2COOCH_2CH(C_2H_5)C_4H_9){-}COOCH_2CH(C_2H_5)C_4H_9$
W-4
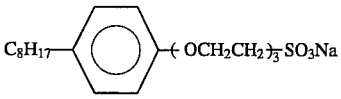
W-5
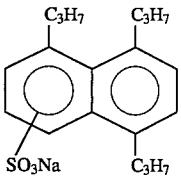

-continued
W-6
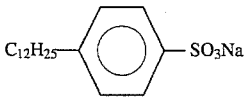
P-1
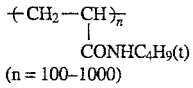
(n = 100–1000)
M-1
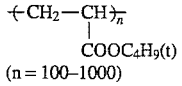
(n = 100–1000)
F-1
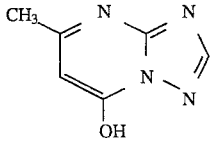
F-2
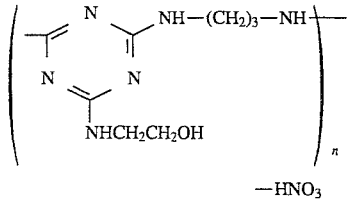
(n = 2–10)
F-3
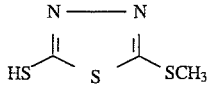
F-4
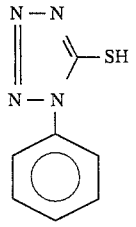
F-5
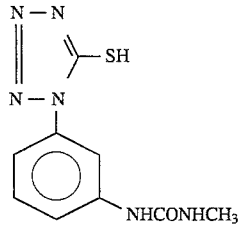
F-6
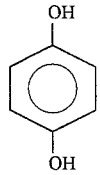
F-7
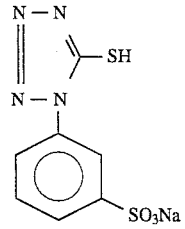

-continued

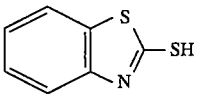

Sample Nos. 502 to 514 were prepared in the same manner as in preparation of Sample No. 501, except that high boiling point organic solvents in 9th, 10th and 11th layers were changed as shown in Table 11 below.

Further, Sample Nos. 510 to 514 were prepared in the same manner as in preparation of Sample Nos. 504 to 507 and 509, respectively, except that Coupler C-8's in 9th, 10th and 11th layers each was replaced with the equimolar amount of C-7.

TABLE 11

| Sample No. | High Boiling Point Organic Solvent in 9th, 10th and 11th layers*[1] | Remarks |
|---|---|---|
| 501 | Tricresyl Phosphate | comparative sample |
| 502 | Dibutyl Phosphate | comparative sample |
| 503 | Trinonyl Phosphate | comparative sample |
| 504 | Tricresyl Phosphate/S-1 | sample of the invention |
| 505 | Tricresyl Phosphate/S-5 | sample of the invention |
| 506 | Tricresyl Phosphate/S-8 | sample of the invention |
| 507 | Tricresyl Phosphate/S-10 | sample of the invention |
| 508 | Tricresyl Phosphate/S-22 | sample of the invention |
| 509 | Tricresyl Phosphate/S-25 | sample of the invention |
| 510 | Tricresyl Phosphate/S-1 | sample of the invention |
| 511 | Tricresyl Phosphate/S-5 | sample of the invention |
| 512 | Tricresyl Phosphate/S-8 | sample of the invention |
| 513 | Tricresyl Phosphate/S-10 | sample of the invention |
| 514 | Tricresyl Phosphate/S-25 | sample of the invention |

*[1]The amount of high boiling point organic solvent added in each layer of Sample No. 502 or 503 was the same in weight as that of tricresyl phosphate added in each layer of Sample No. 501. The amount of tricresyl phosphate added in each layer of Sample No. 501 was reduced by 20% by weight and therefor the compound of the present invention was added in the amount corresponding to 20% by weight of tricresyl phosphate to prepare Sample Nos. 504 to 514.

Sample Nos. 501 to 514 thus prepared were exposed through a wedge for sensitometry using a light source having a color temperature of 4800° K. at an exposure amount of 50 lux·sec.

The exposed samples were processed according to the steps mentioned below.

| Step | Time (min) | Temp. (°C.) |
|---|---|---|
| First Development | 6 | 38 |
| Washing | 2 | 38 |
| Reversal | 2 | 38 |
| Color Development | 6 | 38 |
| Pre-bleaching | 2 | 38 |
| Bleaching | 6 | 38 |
| Fixation | 4 | 38 |
| Washing | 4 | 38 |

F-8

-continued

| Step | Time (min) | Temp. (°C.) |
|---|---|---|
| Final Rinsing | 1 | 25 |

Compositions of the processing solutions used in the above-mentioned process are mentioned below.

| | |
|---|---|
| **First Developer** | |
| Pentasodium Nitrilo-N,N,N-trimethylenephosphonate | 1.5 g |
| Pentasodium Diethylenetriamine-pentaacetate | 2.0 g |
| Sodium Sulfite | 30 g |
| Potassium Hydroquinone.monosulfonate | 20 g |
| Potassium Carbonate | 15 g |
| Sodium Bicarbonate | 12 g |
| 1-Phenyl-4-methyl-4-hydroxymethyl-3-pyrazolidone | 1.5 g |
| Potassium Bromide | 2.5 g |
| Potassium Thiocyanate | 1.2 g |
| Potassium Iodide | 2.0 mg |
| Diethylene Glycol | 13 g |
| Water to make | 1000 ml |
| pH (adjusted with sulfuric acid or potassium hydroxide) | 9.60 |
| **Reversal Solution** | |
| Pentasodium Nitrile-N,N,N-trimethylenephosphonate | 3.0 g |
| Stannous Chloride.Dihydrate | 1.0 g |
| p-Aminophenol | 0.1 g |
| Sodium Hydroxide | 8 g |
| Glacial Acetic Acid | 15 ml |
| Water to make | 1000 ml |
| pH (adjusted with acetic acid or sodium hydroxide) | 6.00 |
| **Color Developer** | |
| Pentasodium Nitrilo-N,N,N-trimethylenephosphonate | 2.0 g |
| Sodium Sulfite | 7.0 g |
| Trisodium Phosphate.12Hydrate | 36 g |
| Potassium Bromide | 1.0 g |
| Potassium Iodide | 90 mg |
| Sodium Hydroxide | 3.0 g |
| Citrazinic Acid | 1.5 g |
| N-ethyl-N-(β-methanesulfonamidoethyl)-3-methyl-4-aminoaniline.3/2 Sulfate.Monohydrate | 11 g |
| 3,6-Dithiaoctane-1,8-diol | 1.0 g |
| Water to make | 1000 ml |
| pH (adjusted with sulfuric acid or potassium hydroxide) | 11.8 |
| **Pre-bleaching** | |
| Disodium Ethylenediaminetetraacetate.Dihydrate | 8.0 g |
| Sodium Sulfite | 6.0 g |
| 1-Thioglycerol | 0.4 g |
| Formaldehyde Sodium Bisulfite Adduct | 30 g |
| Water to make | 1000 ml |
| pH (adjusted with acetic acid or sodium hydroxide) | 6.20 |
| **Bleaching Solution** | |
| Disodium Ethylenediaminetetraacetate.Dihydrate | 2.0 g |
| Ammonium Ethylenediaminetetraacetato Ferrate.Dihydrate | 120 g |

-continued

| | |
|---|---|
| Potassium Bromide | 100 g |
| Ammonium nitrate | 10 g |
| Water to make | 1000 ml |
| pH (adjusted with nitric acid or sodium hydroxide) | 5.70 |
| Fixing Solution | |
| Ammonium Thiosulfate | 80 g |
| Sodium Sulfite | 5.0 g |
| Sodium Bisulfite | 5.0 g |
| Water to make | 1000 ml |
| pH (adjusted with acetic acid or aqueous ammonia) | 6.60 |
| Final Rinsing Solution | |
| 1,2-benzoisothiazoline-3-one | 0.02 g |
| Polyoxyethylene p-Monononylphenyl Ether (mean polymerization degree: 10) | 0.3 g |
| Polymaleic acid (mean molecular weight: 2,000) | 0.1 g |
| Water to make | 1000 ml |
| pH | 7.0 |

As the developing machine, used was H4R-240 Model (hanger-type developing machine having a hanger with claws; made by Noritsu Kohki KK).

The test results obtained are shown in Table 12 below.

The uneven development and the bleaching rate were obtained in the same manner as in Example 2.

As is noted from Table 12 below, the compounds of the present invention were effective in reducing uneven development.

TABLE 12

| Sample No. | | Degree of Uneven Development | Bleaching Rate in Post-bleaching with SR-32 (Sec) |
|---|---|---|---|
| 501 | comparative sample | X (uneven red and green colors) | 420 |
| 502 | comparative sample | X (uneven red and green colors) | 390 |
| 503 | comparative sample | X (uneven red and green colors) | 380 |
| 504 | sample of the invention | ○ | 180 |
| 505 | sample of the invention | Δ(uneven red and green colors) | 230 |
| 506 | sample of the invention | ○ | 180 |
| 507 | sample of the invention | ○ | 220 |
| 508 | sample of the invention | Δ(uneven yellow and blue colors) | 160 |
| 509 | sample of the invention | ○ | 205 |
| 510 | sample of the invention | ○ | 90 |
| 511 | sample of the invention | Δ(uneven red and green colors) | 110 |
| 512 | sample of the invention | ○ | 90 |
| 513 | sample of the invention | ○ | 100 |
| 514 | sample of the invention | ○ | 100 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer, wherein at least one layer on said support contains a photographically useful reagent dispersed in at least one compound represented by formula (1):

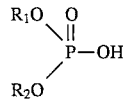

(1)

said compound of formula (1) being liquid at 25° C.; wherein $R_1$ and $R_2$ each independently represents a hydrogen atom, an unsubstituted unsaturated straight-chain aliphatic group, or an unsubstituted branched alkyl group; provided that both $R_1$ and $R_2$ are not hydrogen atoms at the same time and that the sum of the carbon atoms in $R_1$ and $R_2$ is at least 18.

2. The silver halide photographic material as claimed in claim 1, which is a color photographic material comprising a support having provided thereon at least one yellow dye-forming coupler-containing silver halide emulsion layer, at least one magenta dye-forming coupler-containing silver halide emulsion layer and at least one cyan dye-forming coupler-containing silver halide emulsion layer, said yellow dye-forming coupler-containing silver halide emulsion layer, said magenta dye-forming coupler-containing silver halide emulsion layer and said cyan dye-forming coupler-containing silver halide emulsion layer have a different color sensitivity from one another, wherein at least one of said coupler-containing silver halide emulsion layers contains a coupler dispersed in said compound represented by the formula (1).

3. The silver halide photographic material as claimed in claim 2, wherein the coupler dispersed in said compound of formula (1) has an oil PKa' of from 7.0 to 13.0.

4. The silver halide photographic material as claimed in claim 1, wherein at least one layer on said support contains at least one magenta dye-forming coupler.

5. The silver halide color photographic material as claimed in claim 4, wherein the magenta dye-forming coupler is represented by the following formula (m):

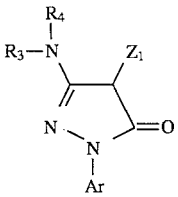

(m)

wherein $R_3$ and $R_4$ each represents an aliphatic group, an aryl group, an acyl group, or a carbamoyl group, or $R_3$ and $R_4$ are bonded to each other to form a ring; Ar represents a phenyl group, or a phenyl group substituted by one or more substituents selected from among a halogen atom, an alkyl group, a cyano group, an alkoxy group, and an acylamino group; and $Z_1$ represents a hydrogen atom, or a group capable of splitting off from the compound by the reaction with an oxidation product of an aromatic primary amine developing agent.

6. The silver halide photographic material according to claim 5, wherein said alkoxy group is an alkoxy carbonyl group.

7. The silver halide photographic material according to claim 1, wherein said layer that contains the compound of formula (1) further comprises a high boiling point organic solvent selected from the group consisting of phthalates, phosphates, phosphonates, amides, sulfonamides, alcohols, phenols, aliphatic carboxylates, anilines and hydrocarbons.

8. The silver halide photographic material according to claim 1, which further comprises a non-light-sensitive hydrophilic colloid layer disposed on said support.

9. The silver halide photographic material according to claim 8, wherein said compound of formula (1) is contained in said non-light-sensitive hydrophilic colloid layer.

10. The silver halide photographic material according to claim 1, wherein the total number of carbon atoms in $R_1$ and $R_2$ is 24 or more.

11. The silver halide photographic material according to claim 1, wherein said compound represented by formula (1) is present in an amount of 0.0002 g to 10 g per $m^2$ of said photographic material.

12. The silver halide photographic material according to claim 1, wherein a ratio of the compound represented by formula (1) to the amount of said photographically useful reagent is from 0.1 to 4 by weight.

13. A silver halide photographic material comprising a support having provided thereon at least one light-sensitive silver halide emulsion layer, wherein at least one layer on said support contains a coupler dispersed in at least one compound represented by formula (1):

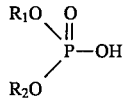

(1)

said compound of formula (1) being liquid at 25° C.; wherein $R_1$ and $R_2$ each independently represents a hydrogen atom, an unsubstituted unsaturated straight-chain aliphatic group, or an unsubstituted branched alkyl group; provided that both $R_1$ and $R_2$ are not hydrogen atoms at the same time and that the sum of the carbon atoms in $R_1$ and $R_2$ is at least 18.

* * * * *